US008943978B2

(12) United States Patent
Soper et al.

(10) Patent No.: US 8,943,978 B2
(45) Date of Patent: Feb. 3, 2015

(54) MODULAR SURFACE MOUNTABLE ENCLOSURE

(71) Applicant: RGB Systems, Inc., Anaheim, CA (US)

(72) Inventors: Matthew Soper, Clayton, NC (US); Osbaldo Rodriguez, Huntington Beach, CA (US); Davy Nget, Chino Hills, CA (US)

(73) Assignee: RGB Systems, Inc., Anaheim, CA (US)

( * ) Notice: Subject to any disclaimer, the term of this patent is extended or adjusted under 35 U.S.C. 154(b) by 40 days.

(21) Appl. No.: 13/892,964

(22) Filed: May 13, 2013

(65) Prior Publication Data

US 2014/0265753 A1 Sep. 18, 2014

Related U.S. Application Data

(60) Provisional application No. 61/785,398, filed on Mar. 14, 2013.

(51) Int. Cl.
*A47B 23/00* (2006.01)
*A47B 21/06* (2006.01)

(52) U.S. Cl.
CPC ..... *A47B 21/06* (2013.01)
USPC ..... 108/50.02

(58) Field of Classification Search
USPC ..... 108/50.01, 50.02; 174/58; 248/229.12, 248/229.22; 312/204, 223.3, 7.2
See application file for complete search history.

(56) References Cited

U.S. PATENT DOCUMENTS

| | | | | |
|---|---|---|---|---|
| 4,792,881 | A * | 12/1988 | Wilson et al. | 361/827 |
| 5,231,562 | A * | 7/1993 | Pierce et al. | 361/832 |
| 6,046,405 | A | 4/2000 | Obermann | |
| 6,244,193 | B1 * | 6/2001 | Gutgsell et al. | 108/50.02 |
| 6,338,301 | B1 * | 1/2002 | Almond | 108/50.02 |
| 6,732,661 | B2 * | 5/2004 | Grasse et al. | 108/50.02 |
| 6,802,577 | B2 * | 10/2004 | Gershfeld | 312/223.3 |
| 7,083,421 | B1 | 8/2006 | Mori | |
| 7,966,951 | B1 * | 6/2011 | Black et al. | 108/50.02 |
| 2009/0165679 | A1 * | 7/2009 | Bakker et al. | 108/50.02 |

FOREIGN PATENT DOCUMENTS

WO 2009/039277 A1 3/2009

OTHER PUBLICATIONS

European Patent Office, Extended European Search Report, Oct. 10, 2014, App. No. EP 14 15 9691.

* cited by examiner

*Primary Examiner* — Matthew Ing
(74) *Attorney, Agent, or Firm* — The Hecker Law Group, PLC

(57) ABSTRACT

A modular, customizable, versatile, easy to use, easy to install, aesthetically pleasing surface mountable enclosure is presented. In one or more embodiments, the enclosure includes a modular housing that is configured to be gangable with one or more other housings to provide a range of sizes and configurations. In one or more embodiments, the modular housing is configured to accept a variety of interchangeable cassettes or modules that provide a variety of cable and power connections or other resources. In one or more embodiments, the modular housing includes an articulating lid mechanism that is configured to smoothly open and slide neatly out of the way while occupying a reduced volume than the lid mechanisms of the prior art. In one or more embodiments, the enclosure includes cam driven mounting clamps that allow the enclosure to be quickly and easily secured to a table top or other mounting surface.

20 Claims, 42 Drawing Sheets

MODULAR SURFACE MOUNTABLE ENCLOSURE

CROSS-REFERENCE TO RELATED PATENT APPLICATIONS

This patent application claims the benefit of the filing date of U.S. Provisional Patent Application Ser. No. 61/785,398 filed on Mar. 14, 2013 which is incorporated by reference in its entirety herein.

BACKGROUND OF THE INVENTION (1) Field of the Invention

The present invention relates to a modular table top and other surface mountable enclosure for electrical cables and connections and other items.

(2) Description of the Related Art

Often it is desirable to provide electrical connections to laptops and other electrical devices when used on a desk or table, for example a conference room table. Prior art enclosures exist that can be mounted in a table top that provide electrical outlets and various cable connections. A typical prior art enclosure consists of a rectangular housing with a bezel or flange that is inserted in an opening cut in a table top or other surface such that the bezel rests on the table top surface adjacent the opening and the housing extends below the table top surface. The enclosure may include a door or lid that folds flush with the table top when the connections provided by the enclosure are not used and access to the interior of the enclosure is not required. FIG. 1 shows an example of an example prior art table top enclosure 100. In the example of FIG. 1 the lid 105 is configured to open by pivoting up along its rear edge and then sliding partially down adjacent to the rear wall of the enclosure so as to be partially recessed when the lid is fully open.

Important aspects of table top enclosures include functionality, customizability and versatility, ease of installation, ease of use, and aesthetics. Functionality, customizability and versatility are important to allow the type and number of cable connections to be tailored to the end user's needs and the particular location in which the enclosure is being used. Ease of installation is important to reduce the time, and therefore cost, of installation. Aesthetics are important because enclosures must not spoil the aesthetics of the table top or other surface in which they are installed.

Prior art table top enclosures have addressed the above aspects to various degrees. However, there remains a need for a table top enclosure that provides improved functionality, customizability, versatility, ease of installation, ease of use, and aesthetics compared to the table top enclosures of the prior art.

BRIEF SUMMARY OF THE INVENTION

A modular, customizable, versatile, easy to use, easy to install, aesthetically pleasing surface mountable enclosure is presented. In one or more embodiments, the enclosure includes a modular housing that is configured to be gangable with one or more other housings to provide a range of sizes and configurations. In one or more embodiments, the modular housing of the invention is configured to accept a variety of interchangeable cassettes or modules that provide a variety of cable and power connections or other resources. In one or more embodiments, the modular housing of the invention includes an articulating lid mechanism that is configured to smoothly open and slide neatly out of the way while occupying a reduced volume than the lid mechanisms of the prior art. In one or more embodiments, the enclosure includes cam driven mounting clamps that allow the enclosure to be quickly and easily secured to a table top or other mounting surface.

BRIEF DESCRIPTION OF THE DRAWINGS

The present invention may be better understood, and its features made apparent to those skilled in the art by referencing the accompanying drawings.

The use of the same reference symbols in different drawings indicates similar or identical items.

DETAILED DESCRIPTION OF THE INVENTION

In the following description, numerous specific details are set forth to provide a more thorough description of the present invention. It will be apparent to one skilled in the art, however, that the present invention may be practiced without those specific details. In other instances, well-known features have not been described in detail so as not to unnecessarily obscure the invention.

Figure 1:
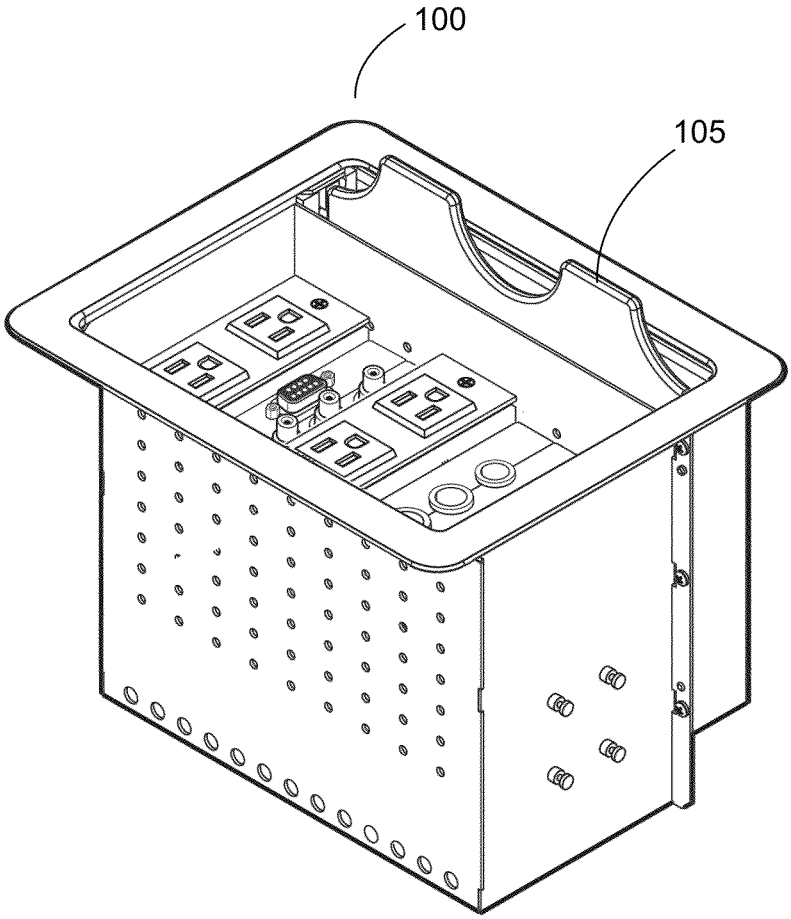
Figure 1 (Prior Art)
FIG. 1 is a perspective view of an enclosure of the prior art.
Figure 2:
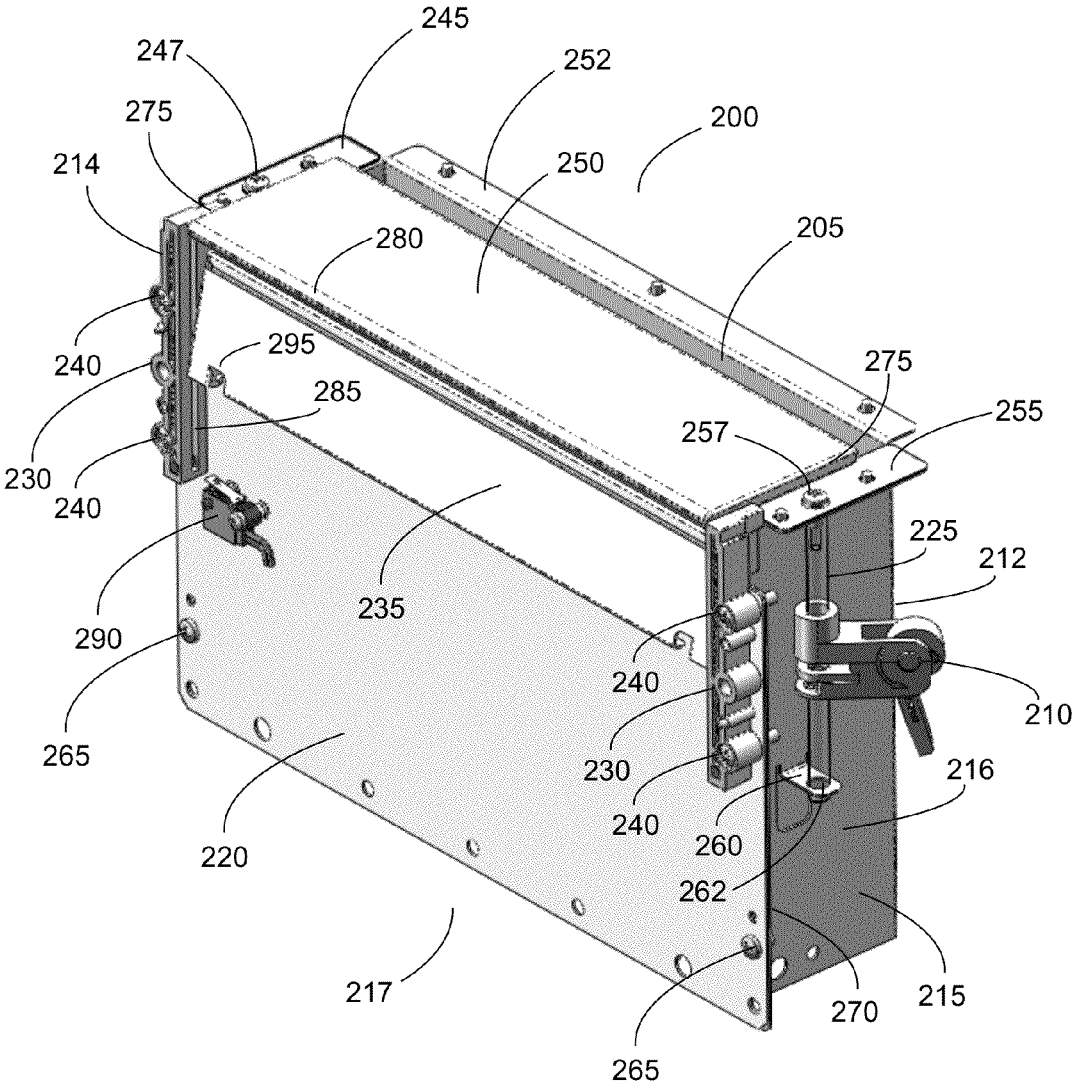
FIG. 2 is a rear perspective view of an enclosure module of an embodiment of the invention.

FIGS. 2-5 show embodiments of enclosure module 200 of one or more embodiments of the invention. In the embodiment of FIG. 2, enclosure module 200 includes a rectangular open-bottomed housing 217 with an articulated lid 250. The back 220 of housing 217 is formed from one piece of material and the left, front, and right sides, 216, 212 and 214, respectively, are formed from a second piece of material 215. Second piece of material 215 may, for example, be formed into its three sided shape by bending, if it comprises sheet metal, or by molding or vacuforming if it comprises a plastic. Lips 245, 252 and 255 are also formed from second piece of material 215 along the top of housing 217. Two additional lips 270 are formed along the edges of second piece of material 215 that are adjacent to back 220. Back 220 is fastened to lips 270 of second piece of material 215 using fasteners 240 and 265, which may, for example, comprise threaded fasteners.

Lid 250 pivots about pins extending from the sides 275 of lid 250 adjacent rear edge 280 that engage and move along slots 285 in brackets 230 to partially recess rear edge 280 behind back 220 of housing 217 when lid 250 is opened. Lid 250 is aided in its movement and supported by lid extension 235, as described in greater detail in connection with FIGS. 20-27 below. Opening 205 between the front of lid 250 and the front 212 of enclosure module 200 provides space for a user's fingers to engage and open lid 250.

In the embodiment of FIG. 2, enclosure module 200 includes two clamping mechanisms 210 that are slidably and rotatably mounted to shafts 225 along either side of enclosure module 200. The top ends of shafts 225 are rotatably mounted to lips 245 and 255 with fasteners 247 and 257, while the bottom ends of shafts 225 are mounted through openings 262 in tabs 260 that project from the sides of second piece of material 215. If second piece of material 215 comprises sheet metal, tabs 260 may be formed by making a u-shaped cut in second piece of material 215 and bending the resulting tab along the top of the "U". Clamping mechanisms 210 are configured to facilitate the mounting of embodiments of the enclosure of the invention to a table top or other surface, as described in greater detail in connection with FIGS. 14-18.

In the embodiment of FIG. 2, enclosure module 200 includes an electrical switch 290 mounted to back 220. The operation of switch 290 is discussed in connection with FIG. 26 below.

Figure 3:
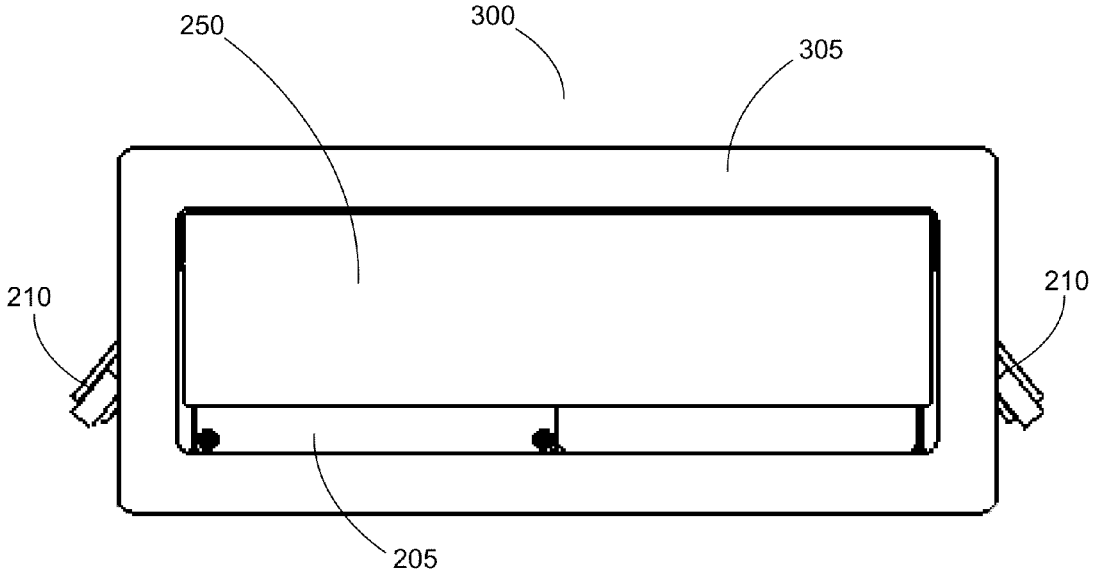
FIG. 3 is a top view of an enclosure of an embodiment of the invention.
Figure 4:
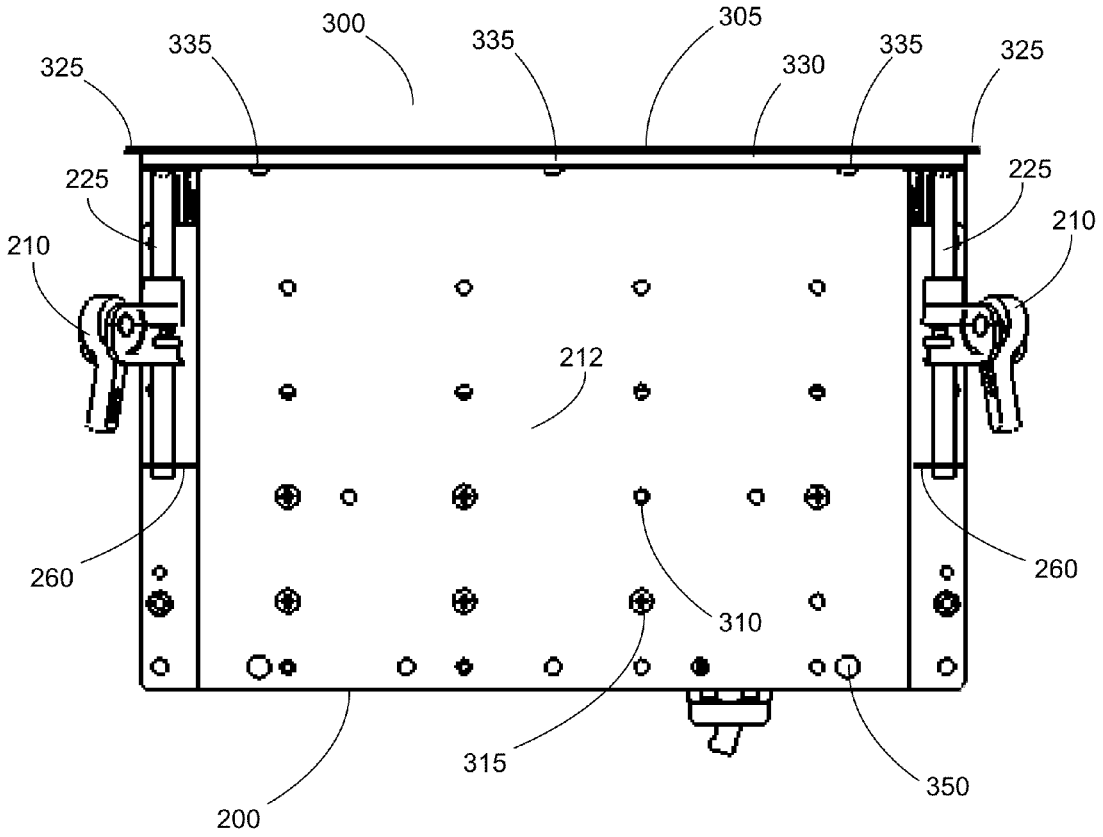
FIG. 4 is a front view of an enclosure of an embodiment of the invention.
Figure 5:
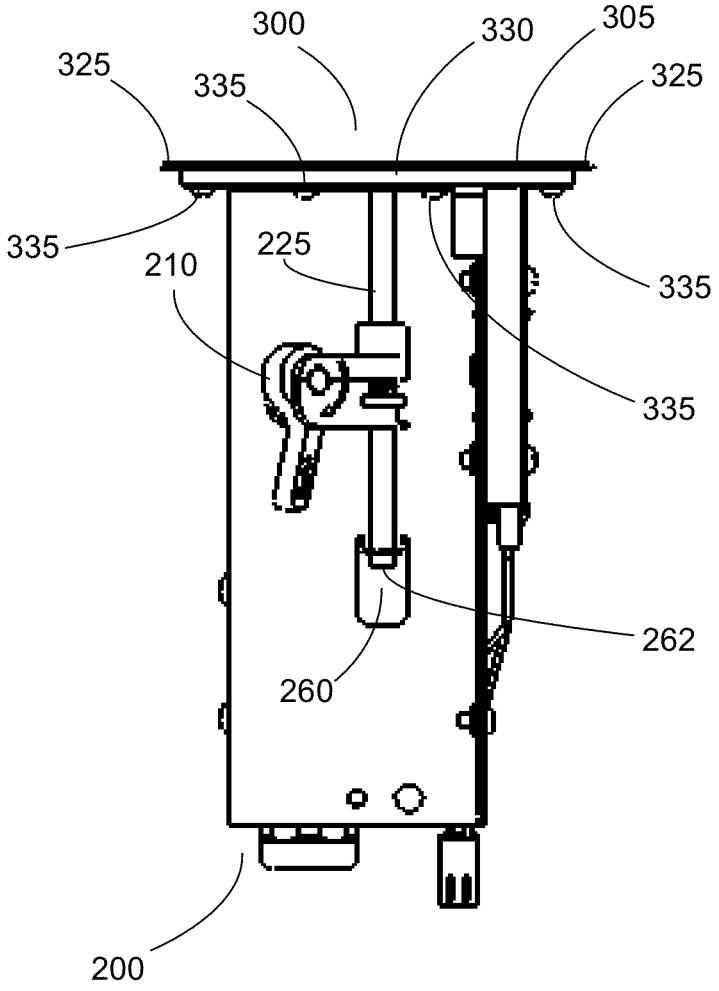
FIG. 5 is a side view of an enclosure of an embodiment of the invention.
Figure 9:
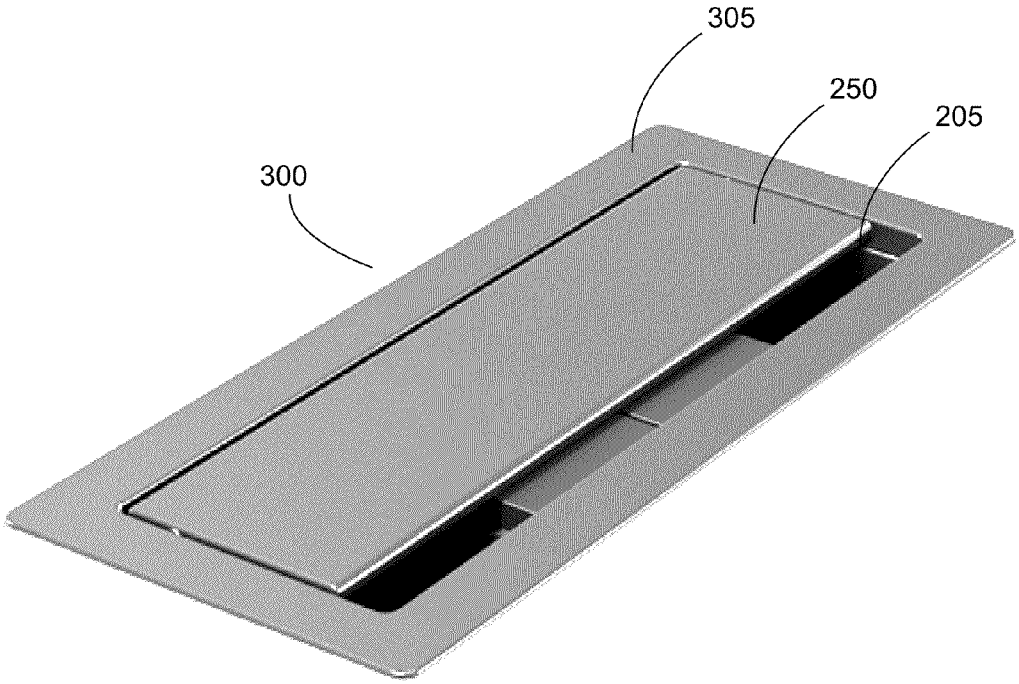
FIG. 9 is a top perspective view of an enclosure of an embodiment of the invention installed in a surface.
Figure 10:
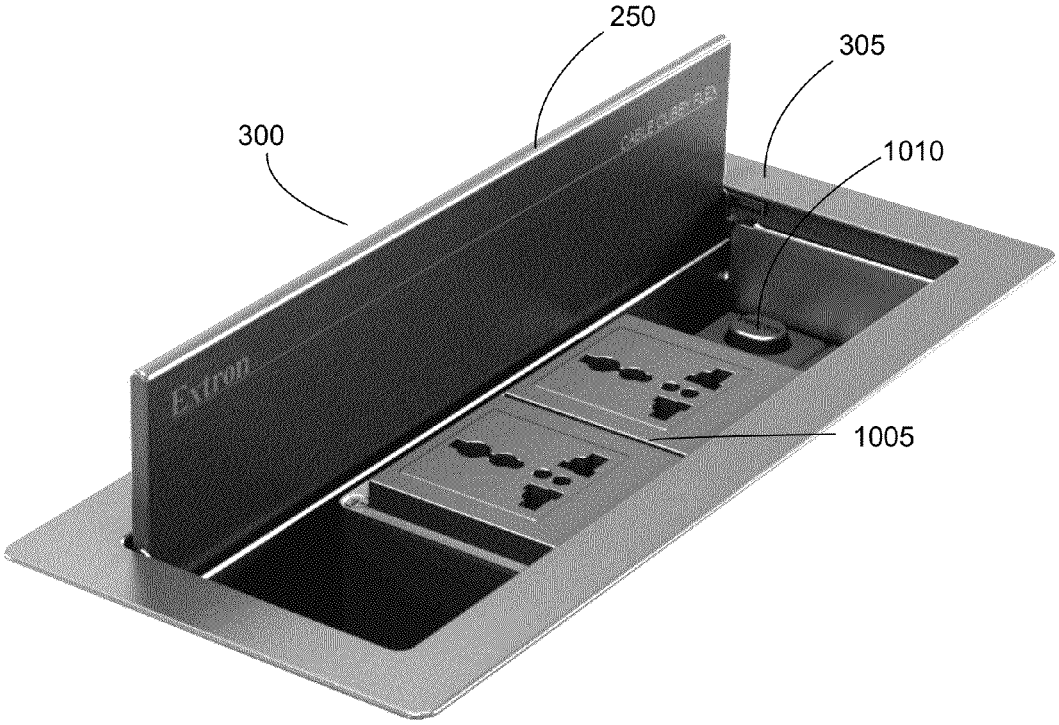
FIG. 10 is a top perspective view of an enclosure of an embodiment of the invention installed in a surface.

FIGS. 3-5 show embodiments of a single module enclosure 300 of the invention. In the embodiments of FIGS. 3-5, a single module bezel 305 is attached to the top of enclosure module 200, forming single module enclosure 300. Single module bezel 305 is used in embodiments of the enclosure of the invention that comprise a single enclosure module 200. In the embodiments of FIGS. 3-5, bezel 305 is fastened to enclosure module 200 with threaded fasteners 335 that engage threaded holes in the bottom of main section 330 of bezel 305 and fasten lips 245, 252 and 255 of enclosure module 200 to the bottom of main section 330 of bezel 305, as shown in FIGS. 4-5. As shown in FIGS. 4-5, bezel 305 also includes a peripheral mounting lip 325 that extends outward from the main body 330 of bezel 305 and that is intended to rest upon a surface, such as a table top, to which enclosure 300 may be mounted. In one or more embodiments, the top of bezel 305 is intended to be decorative and visible when the enclosure 300 is mounted to a table top or other surface, as shown in FIGS. 9 and 10. FIG. 9 shows enclosure 300 with lid 250 in a closed position. FIG. 10 shows enclosure 300 with lid 250 in an opened position. In the embodiment of FIG. 10, a power outlet cassette 1005 and a cable retractor module 1010 are mounted within the interior of enclosure 300.

FIG. 4 is a front view of enclosure 300. In the embodiment of FIG. 4, front side 212 of enclosure module 200 includes a number of holes 310 and 350 configured to receive fasteners, such as screws 315, for mounting interchangeable cassettes or modules, such as power outlet cassette 1005 and cable retractor module 1010 shown in FIG. 10.

Figure 6:
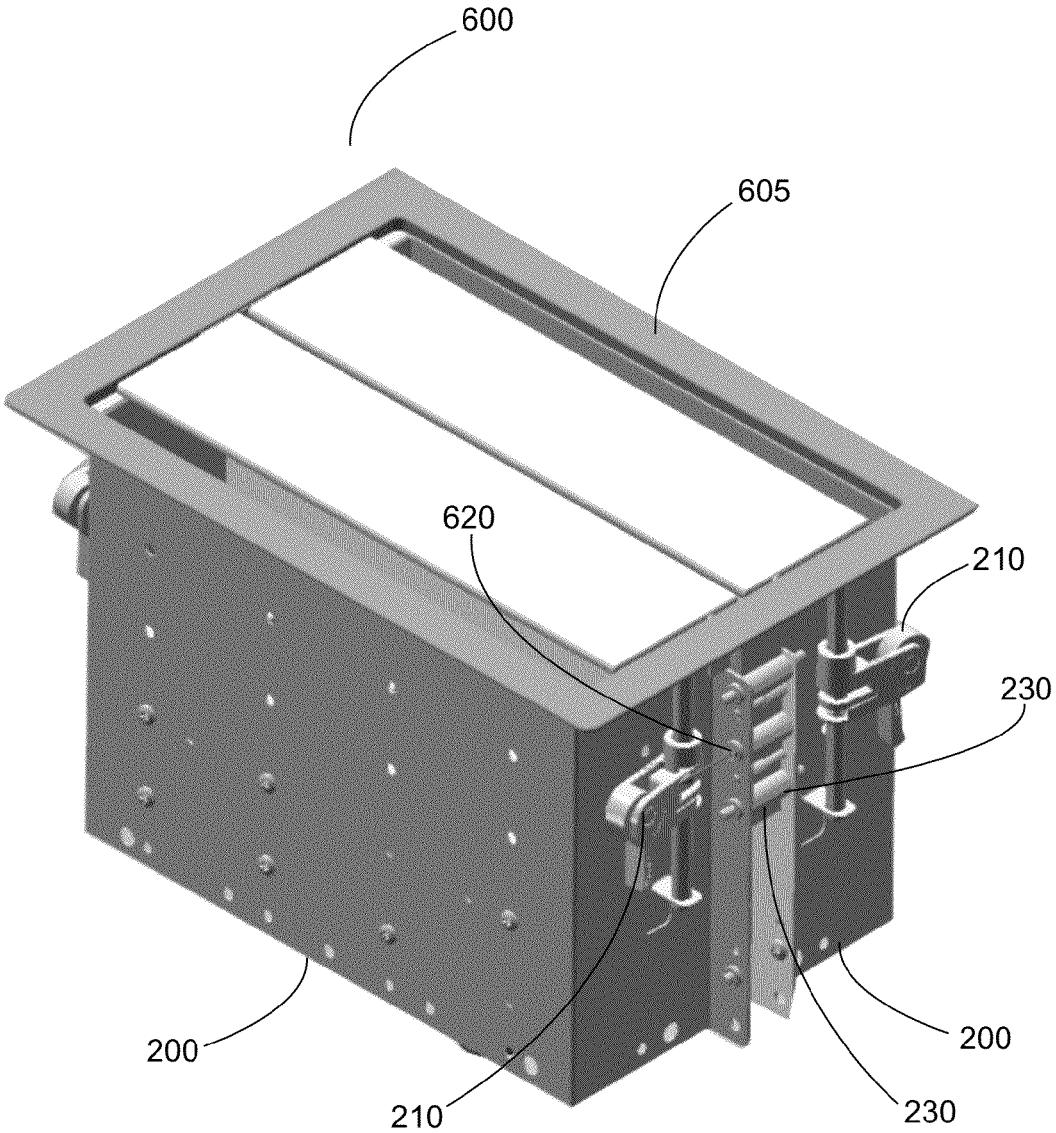
FIG. 6 is a perspective view of an enclosure of an embodiment of the invention.
Figure 7:
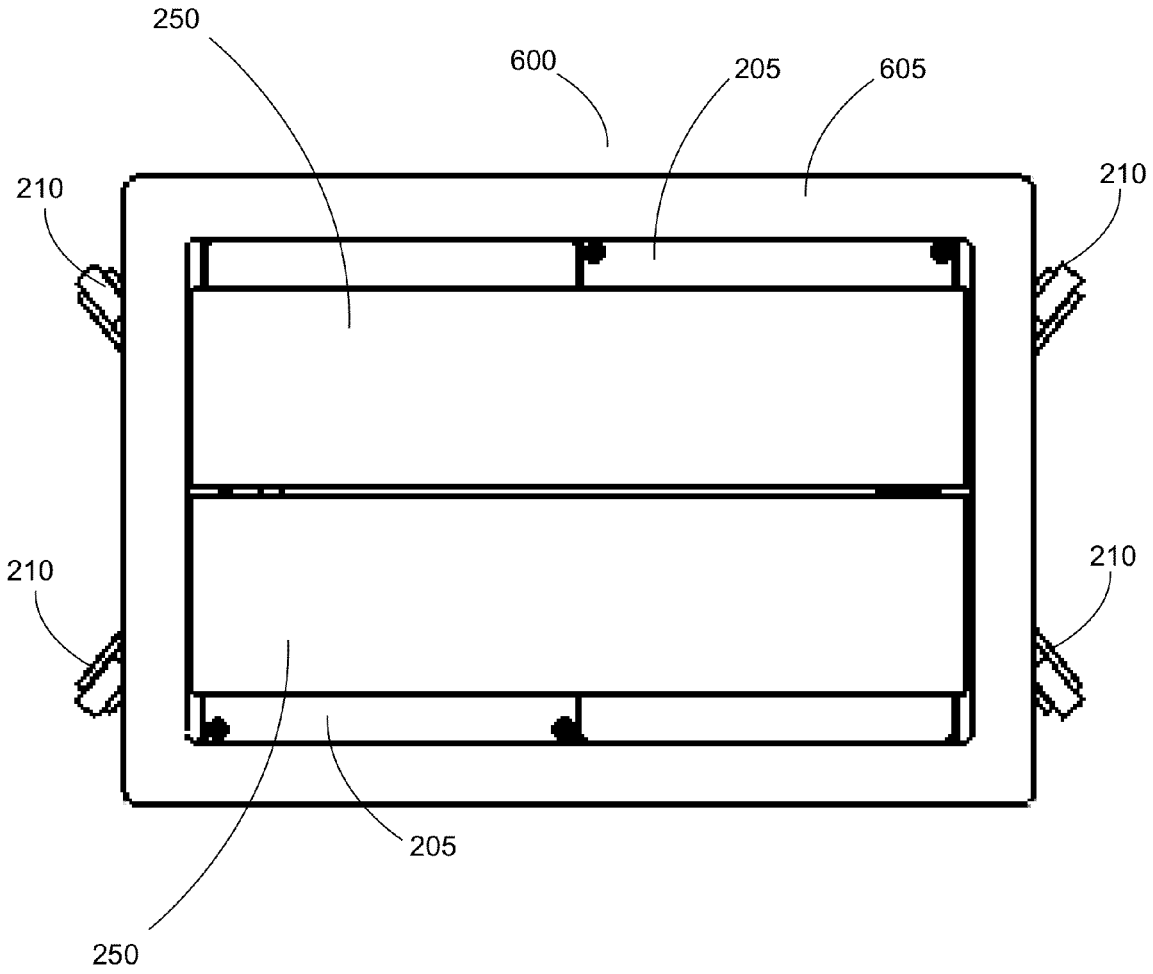
FIG. 7 is a top view of an enclosure of an embodiment of the invention.
Figure 8:
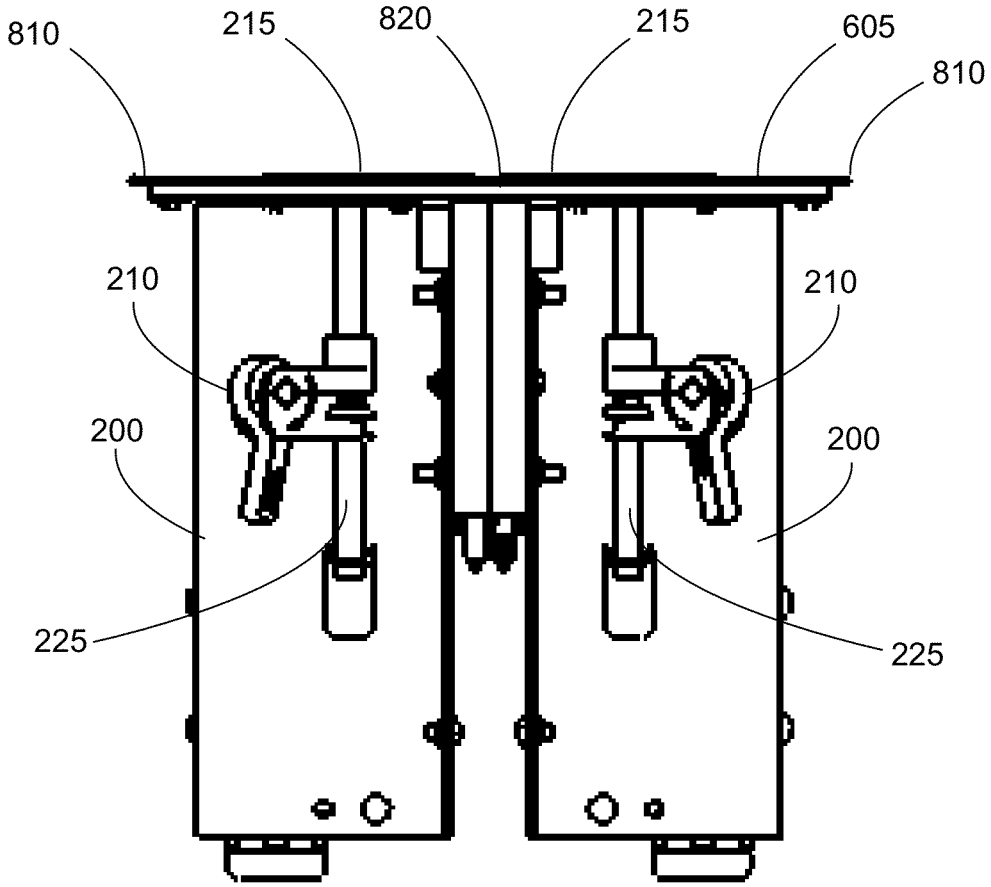
FIG. 8 is a side view of an enclosure of an embodiment of the invention.
Figure 11:
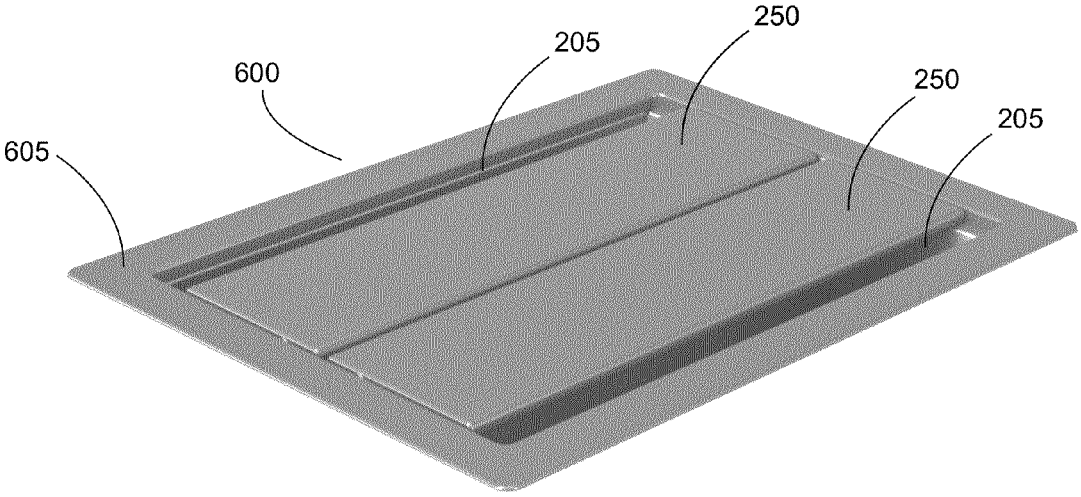
FIG. 11 is a top perspective view of an enclosure of an embodiment of the invention installed in a surface.
Figure 12:
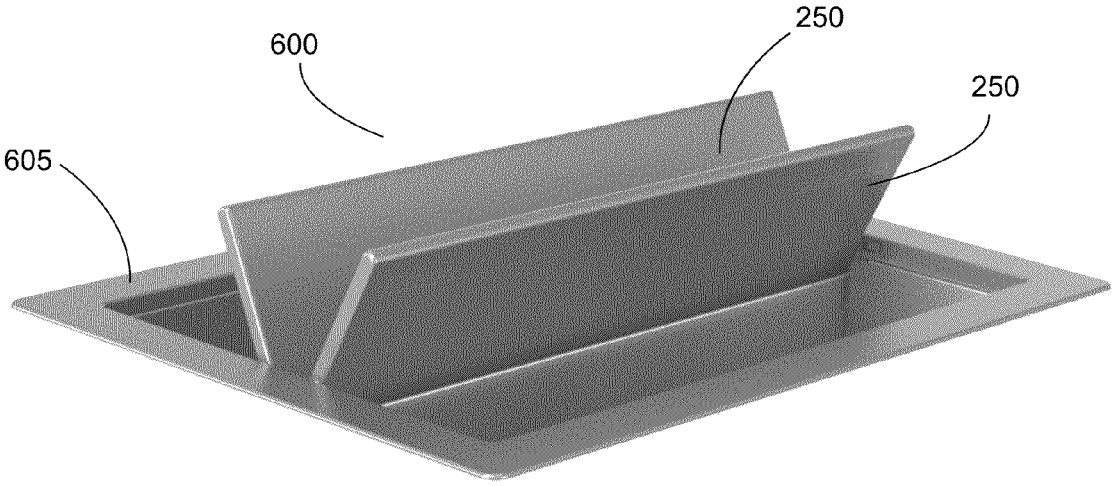
FIG. 12 is a top perspective view of an enclosure of an embodiment of the invention installed in a surface.
Figure 13:
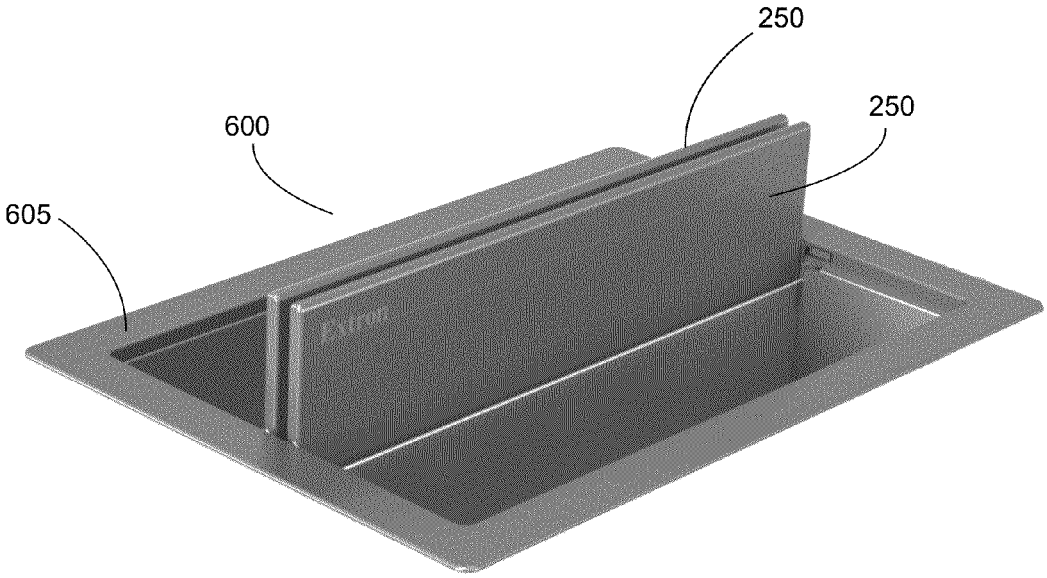
FIG. 13 is a top perspective view of an enclosure of an embodiment of the invention installed in a surface.

FIGS. 6-8 show embodiments of a two module enclosure 600 of the invention. In the embodiments of FIGS. 6-8, enclosure 600 includes two modules 200 joined back to back using, for example, threaded fasteners 620 that bind together respective brackets 230 of each enclosure module 200. A dual module bezel 605 is attached to the tops of the two joined modules 200 in the same manner as bezel 305 is attached to a single enclosure module 200 in the embodiments of FIGS. 3-5. Like bezel 305, bezel 605 includes a peripheral mounting lip 810 that extends outward from main section 820 of bezel 605, as shown in FIG. 8. In one or more embodiments, the top of dual module bezel 605 is intended to be decorative and visible when enclosure 600 is mounted to a table top or other surface, as shown in FIGS. 11-13. FIG. 11 shows enclosure 600 with both lids 250 in a closed position. FIG. 12 shows enclosure 600 with both lids 250 in a partially open position. FIG. 13 shows enclosure 600 with both lids 250 in an opened position.

FIGS. 15-18 show embodiments of clamping mechanism 210 of one or more embodiments of the invention. In the embodiments of FIGS. 15-18, clamping mechanism 210 includes a bracket 1500 slidably mounted to shaft 225, a cam lever 1505 rotatably mounted to bracket 1500 by pin 1520, a locking plate 1510, and a spring 1515.

Figure 17:
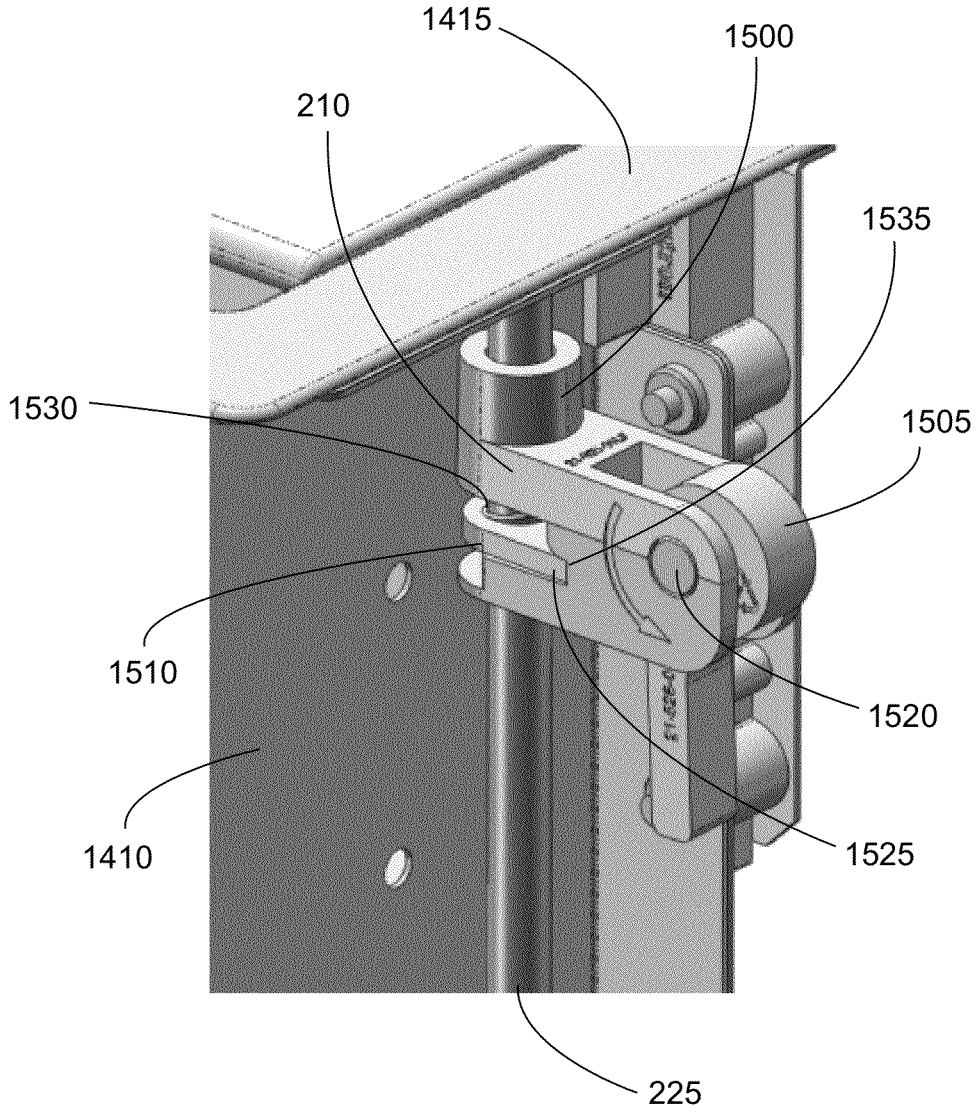
FIG. 17 is a perspective view of a clamping mechanism of an embodiment of the invention.
Figure 18:
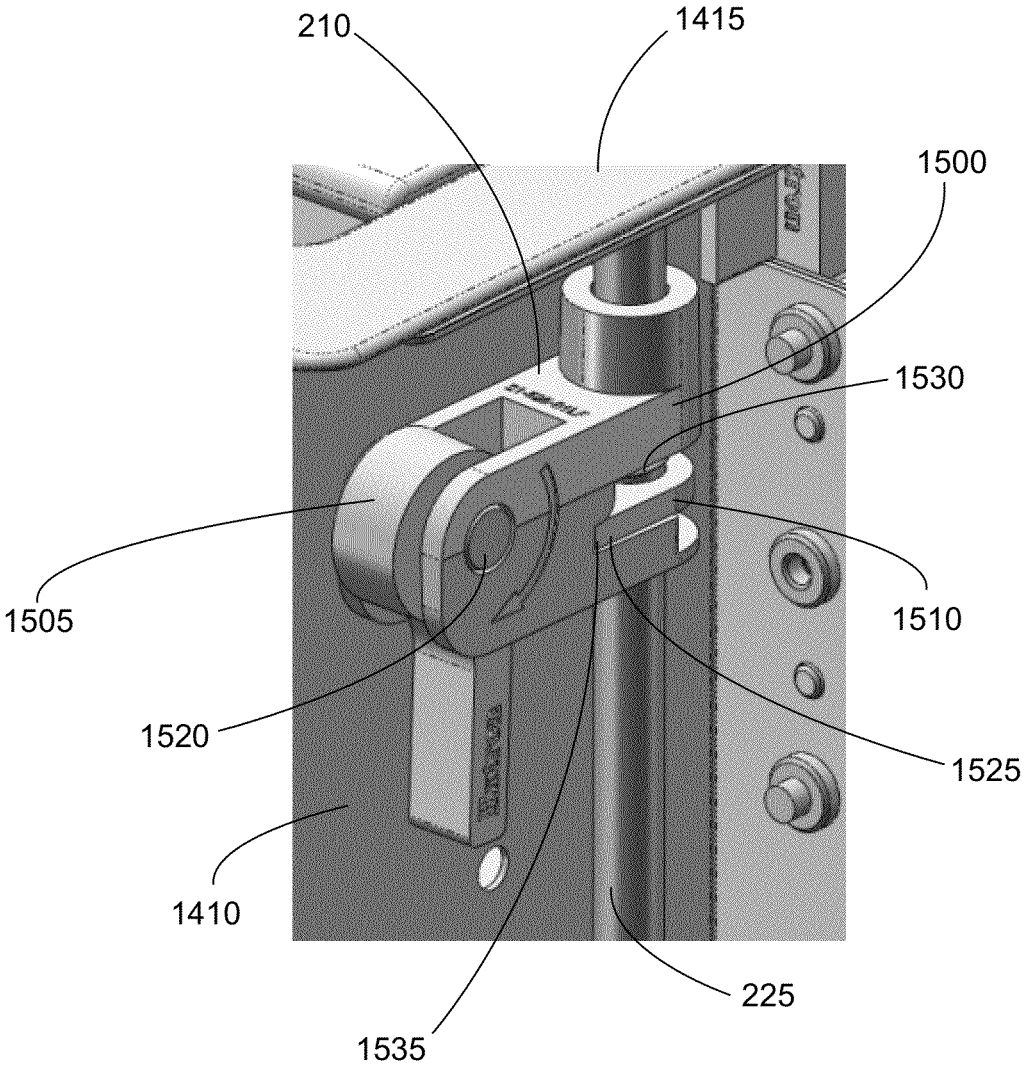
FIG. 18 is a perspective view of a clamping mechanism of an embodiment of the invention.

As shown in FIGS. 17 and 18, locking plate 1510 has an opening 1530 through which it engages shaft 225. The rear 1525 of locking plate 1510 engages a notch 1535 in bracket 1500. In addition, a compression spring 1515 (shown in FIG. 15) biases the front of locking plate 1510 upwards, while notch 1535 prevents the upward movement of the rear of locking plate. As a result, locking plate 1510 becomes slightly inclined, causing the effective size of opening 1530 of locking plate 1510 that engages shaft 225 to be reduced, such that the edges of opening 1530 press against shaft 225, thereby preventing downward movement of clamping mechanism 210 along shaft 225. Upward movement of clamping mechanism 210 along shaft 225 is not restrained, however. Exerting an upward force on bracket 1500 (for example by the hand of an installer) reduces the incline of locking plate 1510, effectively expanding the size of opening 1530 that engages shaft 225, and allowing clamping mechanism 210 to slide upwards on shaft 225.

As shown in FIGS. 17 and 18, clamping mechanism 210 is rotatable about the vertical axis of shaft 225. FIG. 18 shows clamping mechanism 210 rotated so that bracket 1500 is parallel to the side of enclosure 1410 such that it can be inserted along with enclosure 1410 through an opening in a table top or other surface to which enclosure 1410 is to be mounted. FIG. 17 shows clamping mechanism 210 rotated such that bracket 1500 is perpendicular to the side of enclosure 1410 such that it extends outwardly from bezel 1415 of enclosure 1410.

Figure 16:
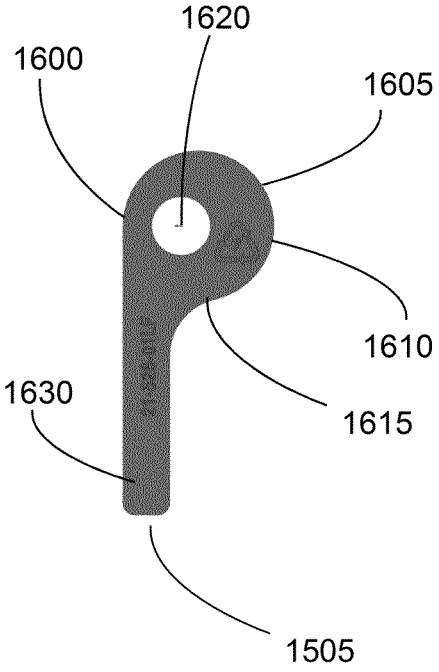
FIG. 16 is a side view of a cam lever of an embodiment of the invention.

FIG. 16 shows a cam lever 1505 of one or more embodiments of the invention. In the embodiment of FIG. 16, cam lever 1505 includes a lever end 1630, a cam lobe 1605, and a bore 1620. Bore 1620 is configured to engage pin 1520 of cam mechanism 210 (as shown, for example, in FIGS. 17-18). Cam lobe 1605 is configured to have a radius with respect to the center of bore 1620 that increases from a minimum value at 1600 to a maximum value at 1610 then decreases again to value 1615 that is somewhat less than maximum value 1610.

Figure 14:
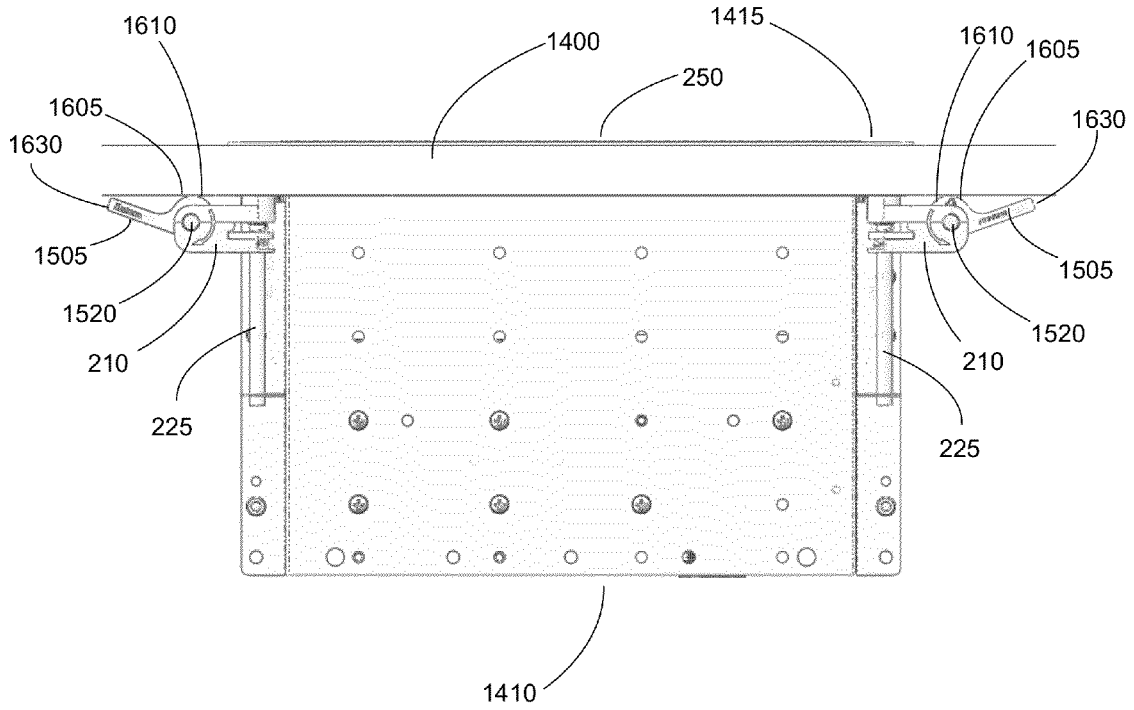
FIG. 14 is a front view of an enclosure of an embodiment of the invention installed in a surface.
Figure 15:
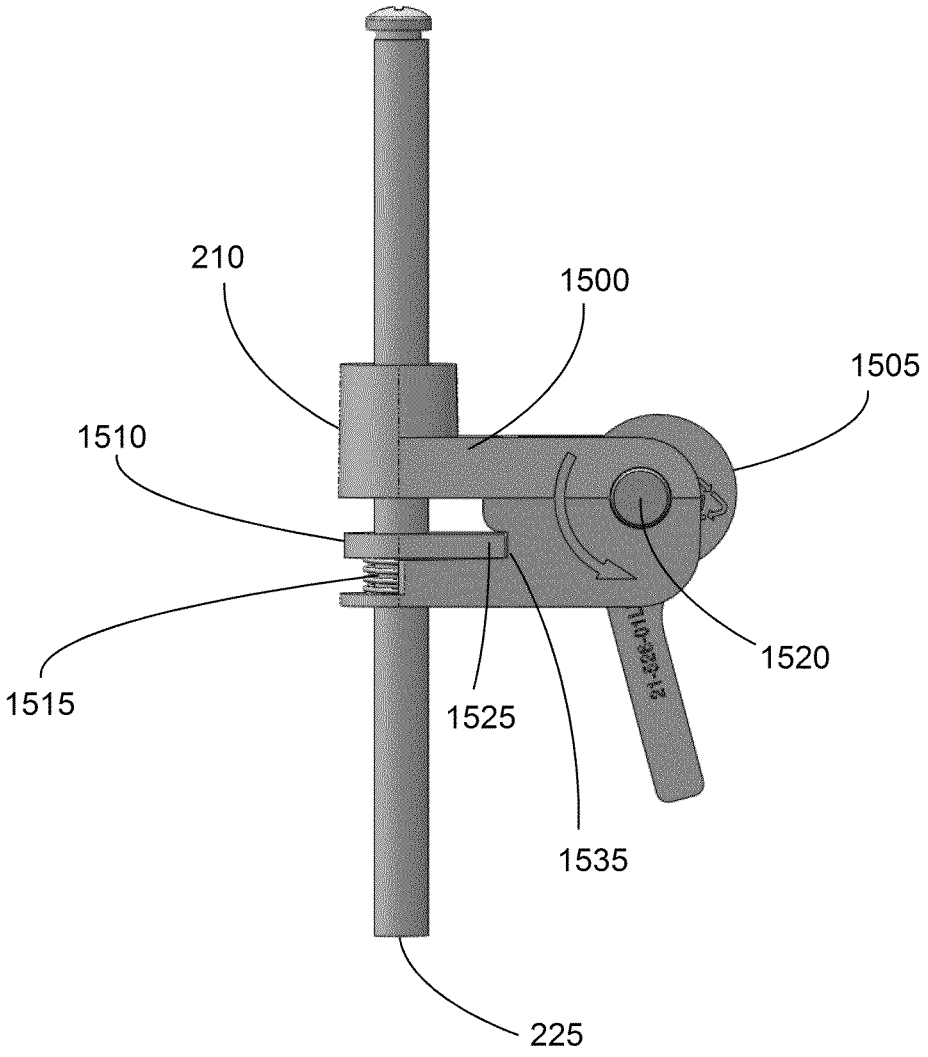
FIG. 15 is a side view of a clamping mechanism of an embodiment of the invention.

FIG. 14 shows how clamping mechanisms 210 may be used to secure an enclosure 1410 of the invention to a table top or other surface 1400 in one or more embodiments of the invention. After enclosure 1410 is inserted in an opening in surface 1400 (with clamping mechanisms 210 rotated parallel to the sides of enclosure 1410 in the orientation shown in FIG. 18), clamping mechanisms 210 are rotated perpendicular to the sides of enclosure 1410 (to the orientation shown in FIG. 17). Each clamping mechanism 210 is then slid upwards on shaft 225 until its cam lobe 1605 contacts the underside of surface 1400. Cam levers 1505 are then rotated about pins 1520 until ends 1630 of cam levers 1505 are contact the underside of surface 1400, as shown in FIG. 14. Cam levers 1505 are configured that when ends 1630 are in the orientation shown in FIG. 14, cam lobes 1605 have been rotated a bit over center (i.e. over cam lobes 1605's maximum widths 1610), such that ends 1630 of cam levers 1505 are locked in place against the underside of surface 1400, with cam lobes 1605 and ends 1630 exerting pressure against underside of surface 1400 while bezel 1415 exerts pressure against the top of surface 1400, thereby securing enclosure 1410 to surface 1400.

Figure 19:
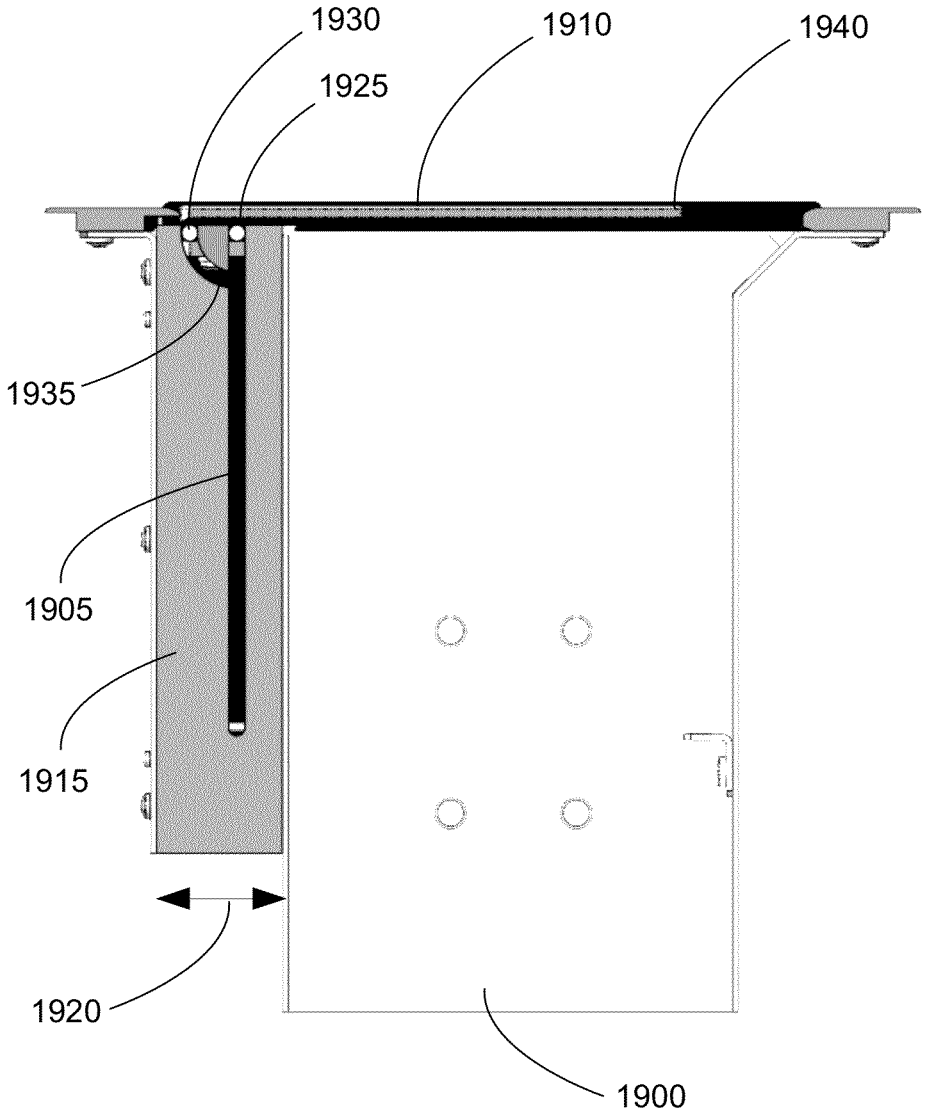
Figure 19 (Prior Art)
FIG. 19 is a side view of a lid mechanism of the prior art.

FIG. 19 shows a lid retraction mechanism 1915 of a prior art enclosure 1900. The lid retraction mechanism 1915 includes a y-shaped slot 1905 that engages pins 1925 and 1930 that extend from lid 1910. The mechanism operates as follows. When the front edge 1940 of lid 1910 is lifted, pin 1930 moves along branch 1935 of slot 1905, causing lid 1910 to pivot about pin 1925 while pin 1925 is maintained in position at the top of channel 1905. After lid 1910 has pivoted about 90 degrees about pin 1925, pin 1930 reaches the main channel of slot 1905. Pins 1925 and 1930 are then in position to move down slot 1905, retracting lid 1910 into lid retraction mechanism 1915. The width 1920 of prior art lid retraction mechanism 1915 reduces the usable volume of enclosure 1900 by occupying a volume that could otherwise be part of the usable interior volume of enclosure 1900.

Figure 25:
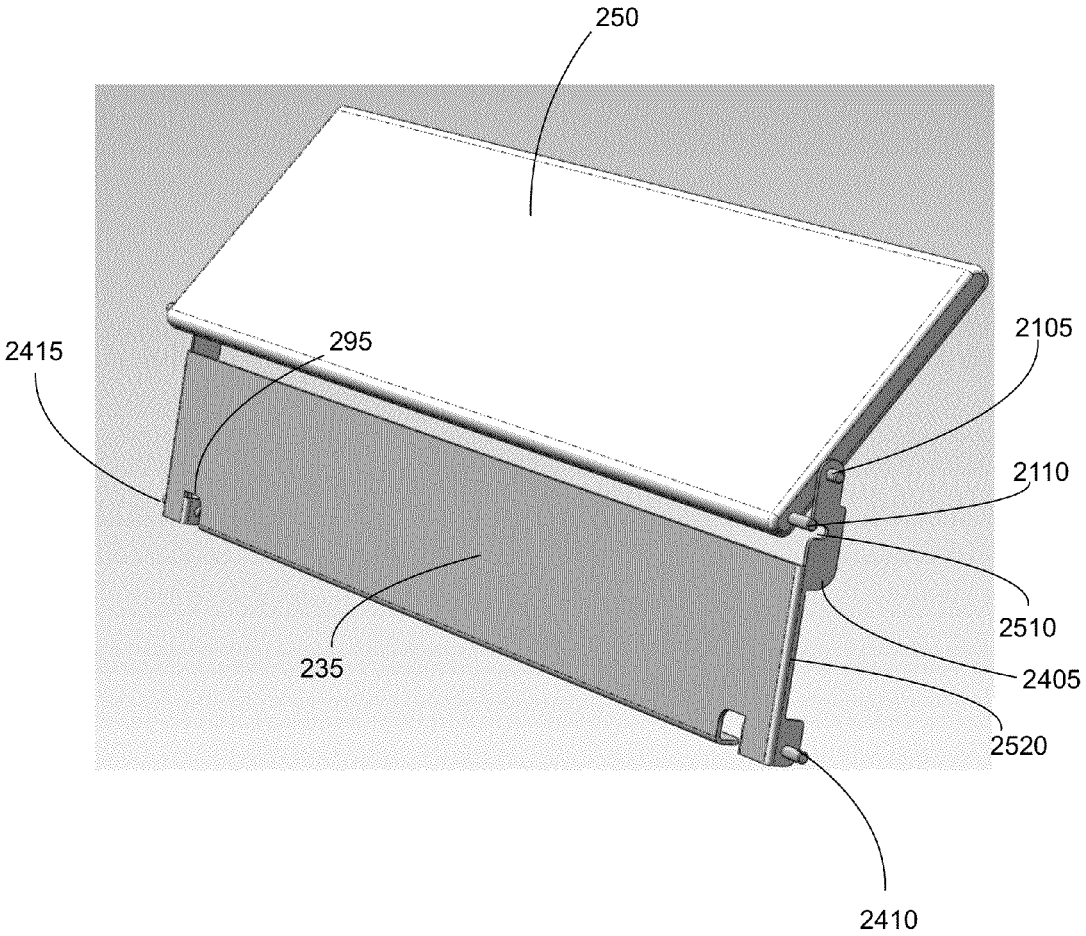
FIG. 25 is a side perspective view of a lid mechanism of an embodiment of the invention.
Figure 26:
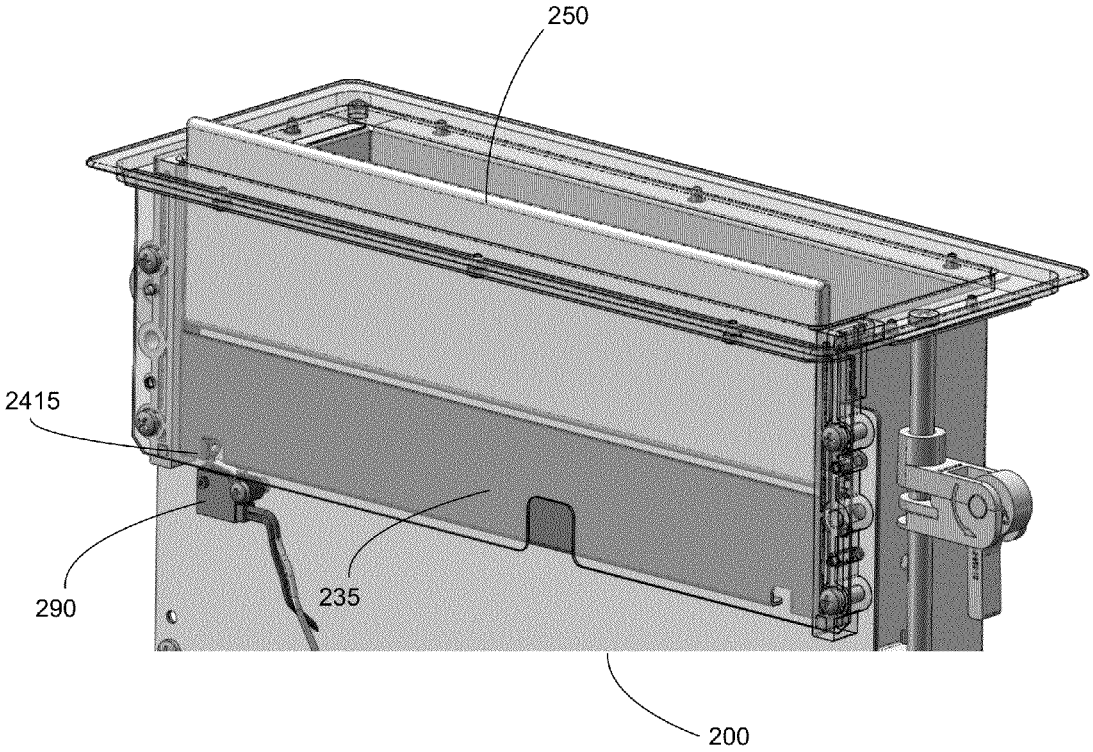
FIG. 26 is a perspective phantom view of a lid mechanism of an embodiment of the invention.
Figure 27:
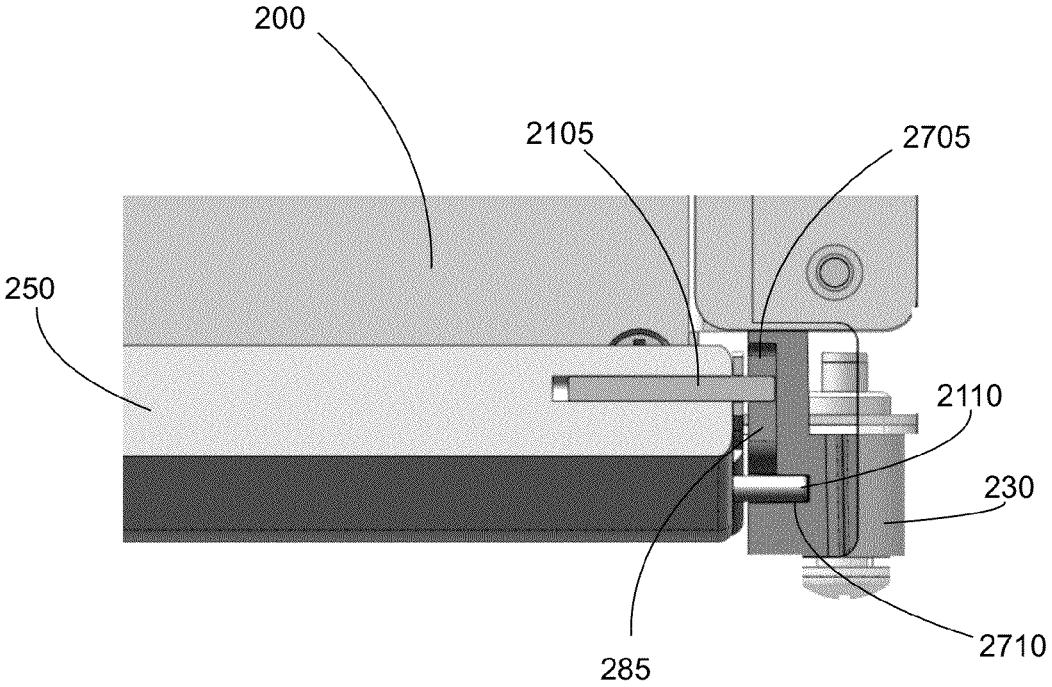
FIG. 27 is a top view of a lid mechanism of an embodiment of the invention.

FIGS. 2 and 20-28 show embodiments of a lid retraction mechanism of the invention that occupies less space than the lid retraction mechanism of the prior art shown in FIG. 19. The lid retraction mechanism of the embodiment of FIG. 2 includes a pair of brackets 230, lid 250 and lid extension 235. Brackets 230 are fastened to each side of back 220 of enclosure module 200. Each bracket 230, which is a mirror image of the other bracket 230, includes an inverted L-shaped channel 285 comprising a long vertical channel section 2710 and a shorter horizontal channel section 2705, as shown in greater detail in FIG. 28. Two pins 2105 and 2110 that extend from the sides of lid 250 engage channel 285, as shown, for example, in FIGS. 27 and 28. In the embodiment of FIG. 27, vertical channel section 2710 is deeper than horizontal channel section 2705, and pin 2710 extends outward from lid 250 a greater distance than pin 2705.

Lid extension 235 is pivotally connected to pins 2105 via holes in side flanges 2405, as shown in FIG. 25. In addition, lid extension 235 includes pins 2410 that extend outwards from the side flanges 2405 of lid extension 235 that also engage channels 285 of brackets 230. Side flanges 2405 also include cut outs 2510 that are configured to engage pins 2110 of lid 250 when lid 250 is in a vertical position. In the embodiment of FIG. 25, side flanges 2405 also include cut outs 2520. Lid extension 235 helps guide lid 250 along channels 285 and provides additional stiffness and support to lid 250 while lid 250 is being opened or closed.

Figure 22:
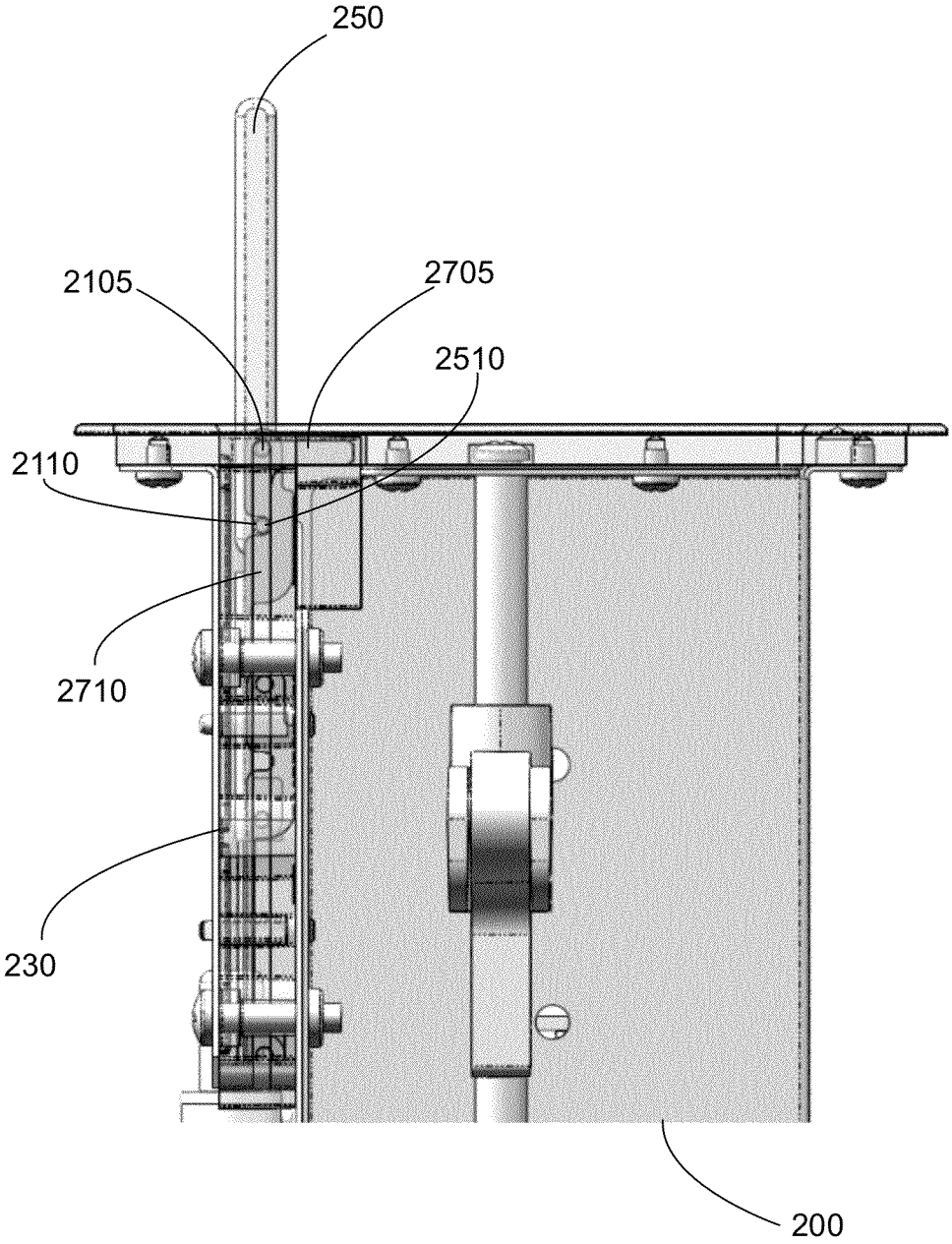
FIG. 22 is a side phantom view of a lid mechanism of an embodiment of the invention.
Figure 23:
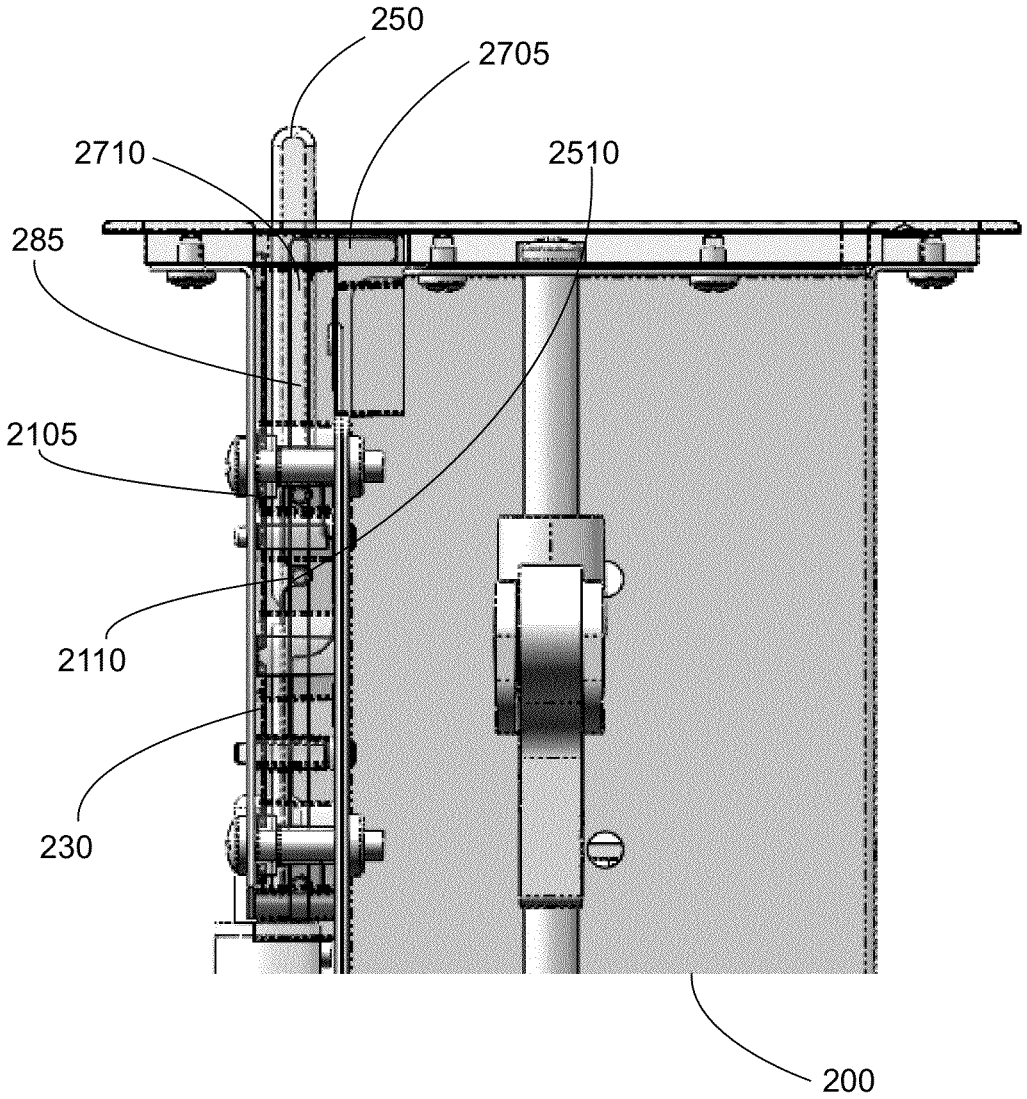
FIG. 23 is a side phantom view of a lid mechanism of an embodiment of the invention.
Figure 24:
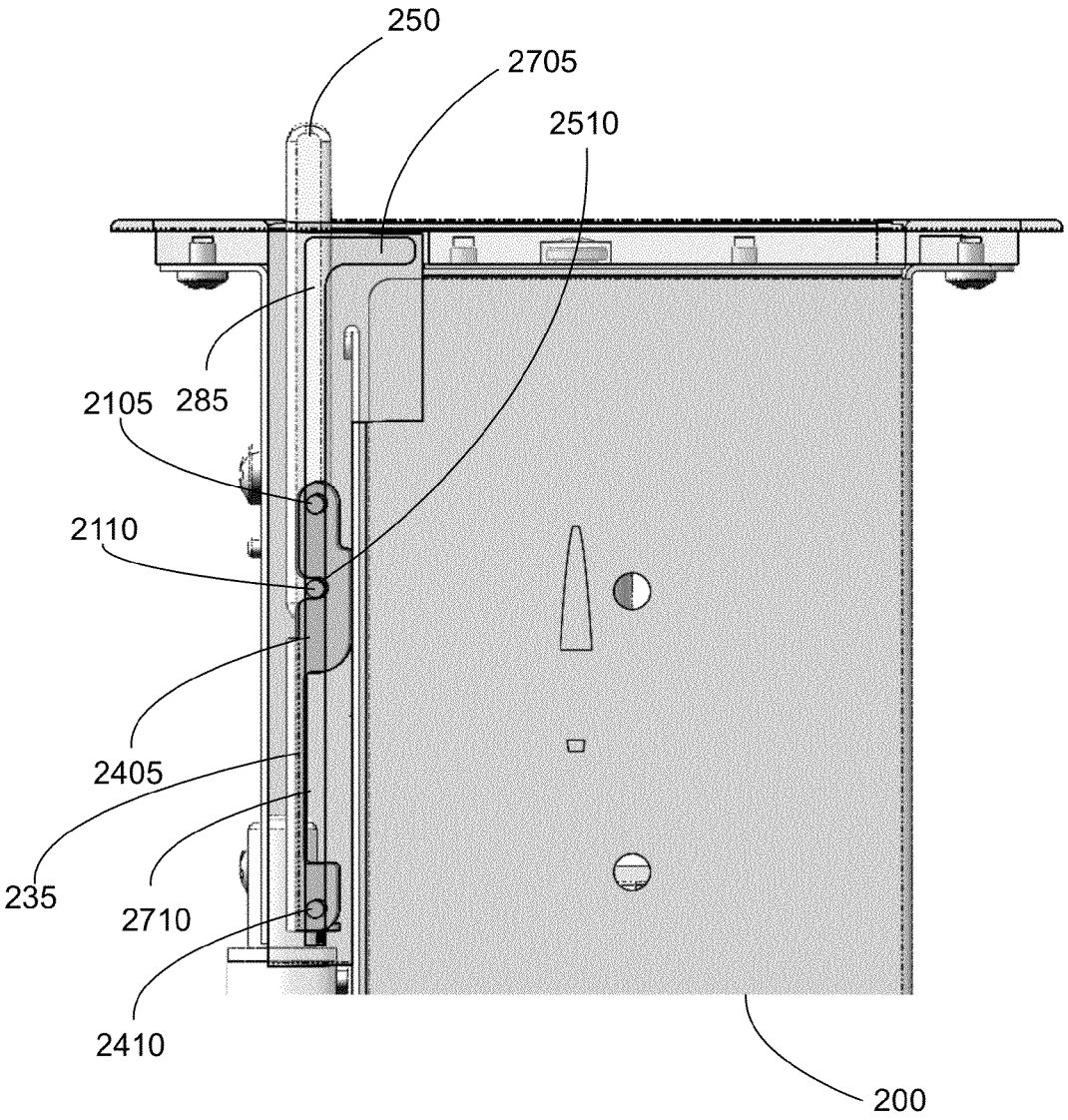
FIG. 24 is a side phantom view of a lid mechanism of an embodiment of the invention.
Figure 28:
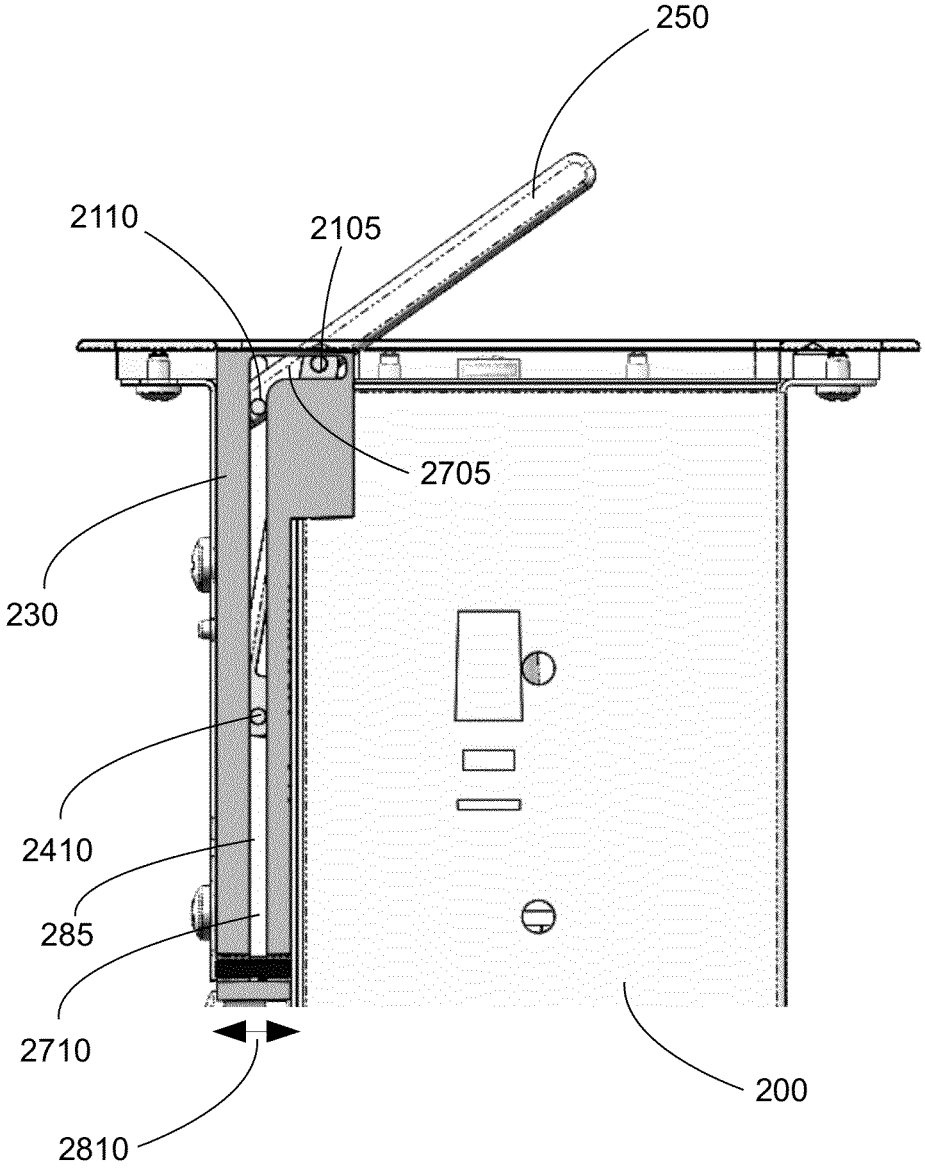
FIG. 28 is a side phantom view of a lid mechanism of an embodiment of the invention.

FIGS. 20-24 and 28 show the interaction of lid 250, lid extension 235 and channels 285 when lid 250 is moved from a horizontal, closed position (shown in FIG. 20) to a vertical, open and recessed position (shown in FIG. 24). When lid 250 is in the horizontal, closed position, pin 2105 is positioned at the front of horizontal channel section 2705, pin 2110 is positioned at the junction of horizontal channel section 2705 and vertical channel section 2710, and pin 2410 is disposed along vertical channel section 2710. As lid is opened (as shown in FIG. 28), pin 2105 moves horizontally along backwards along horizontal channel section 2705, while pins 2110 and 2410 move vertically downwards along vertical channel section 2710. Pin 2105 reaches the juncture between horizontal channel section 2705 and vertical channel section 2710 when lid 250 reaches its initial vertical position, as shown in FIG. 22. At that point, pins 2105, 2110 and 2410 are all disposed in vertical channel section 2705, and lid 250 can move vertically downward until it reaches its recessed position, shown in FIGS. 24 and 26. The lid opening mechanism of the embodiments of FIGS. 2 and 20-28 results in a novel articulated lid mechanism that provides a smooth lid opening action and positive retention of lid 250 in the opened position. Further, it occupies less volume than the prior art lid opening mechanism of FIG. 19, as is evident by comparing width 2810 of FIG. 28 to width 1920 of FIG. 19.

In one or more embodiments, the lid opening mechanism of the invention includes a switch 290, as shown in FIGS. 2 and 26, which may be fastened to rear 220 of enclosure module 200. In the embodiment of FIGS. 2 and 26, lid extension 235 includes a notch 295 that engages and actuate switch 290 when lid 250 is in its fully recessed position as shown in FIG. 26. In one or more embodiments, switch 290 is configured to generate a signal indicating that lid 250 has been opened that can be used by power receptacles (e.g. to switch on power) or other modules or cassettes that may mounted in the enclosure of the invention.

Figure 29:
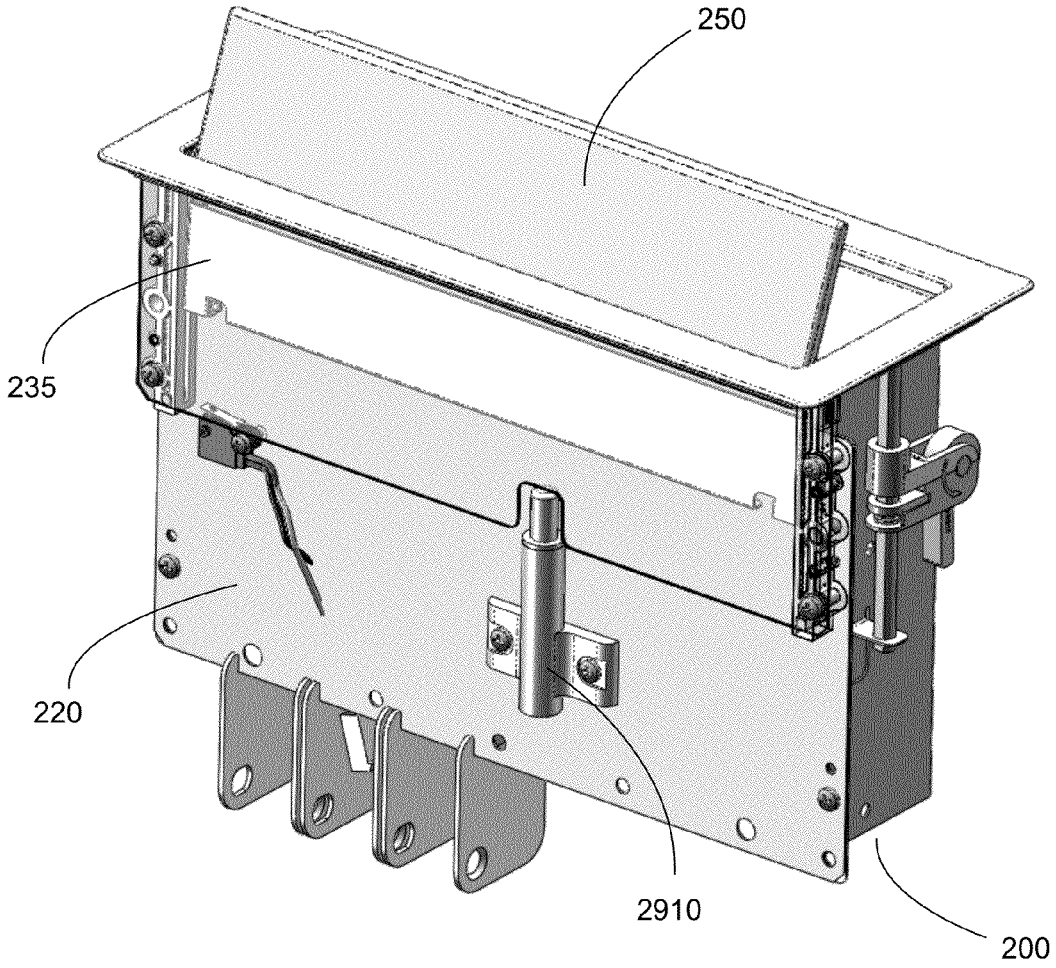
FIG. 29 is a rear perspective phantom view of a lid mechanism of an embodiment of the invention.

In one or more embodiments, a linear damper 2910 may be attached to rear 220 of enclosure module 200, as shown in FIG. 29. In the embodiment of FIG. 29, linear damper 2910 engages the bottom of lid extension 235 as lid extension approaches the bottom of its travel, smoothly decelerating lid extension 235 and lid 250 as they reach their fully retracted positions.

Figure 30:
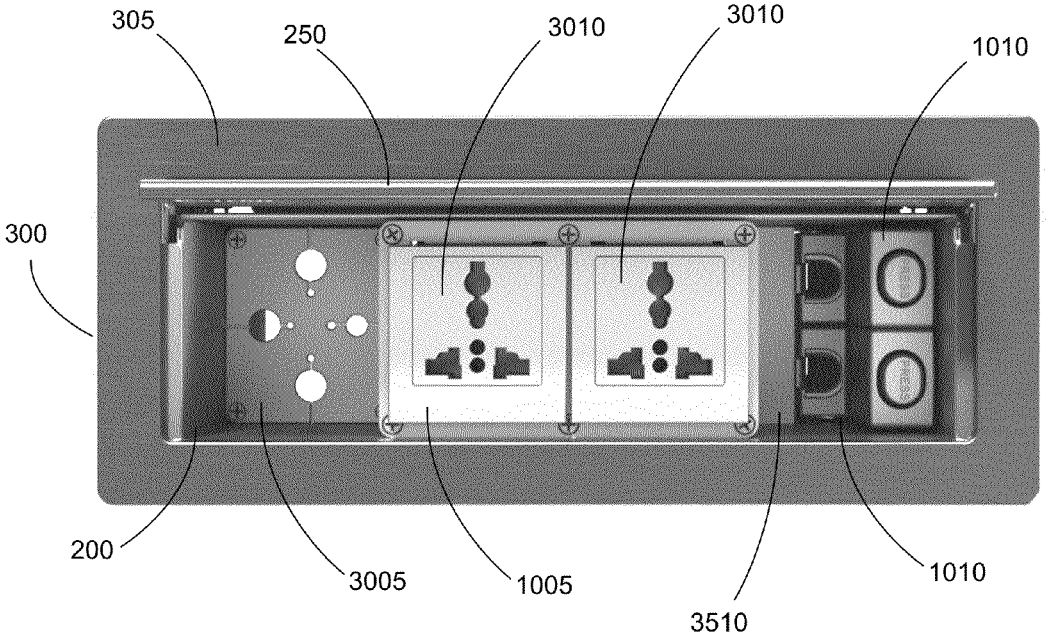
FIG. 30 is a top view of an enclosure of an embodiment of the invention.

FIGS. 30-40 show embodiments of interchangeable cassettes and modules that may be mounted within enclosure modules 200 in one or more embodiments of the invention. FIG. 30 is a top view of an enclosure 300 incorporating a single enclosure module 200. Lid 250 is shown in an opened position exposing the interior of enclosure module 200. In the embodiment of FIG. 30, the interior of enclosure module is configured to accept four "gangs" of cassettes or modules that provide various kinds of functionality. In the embodiment of FIG. 30, two cassettes 3005 and 1005 and two modules 1010 are mounted inside of enclosure module 200. Cassette 3005 is a single gang cable holder cassette that provides a convenient facility for holding the ends of cables, as described further below in connection with FIGS. 36-38. Cassette 1005 is a two-gang 220 Volt power cassette that provides two 220 Volt power outlets 3010. Each module 1010 is an approximately half-gang sized cable retractor module, which may, for example, have the configuration described in co-pending U.S. patent application Ser. No. 12/795,611, filed Jun. 7, 2010, the disclosure of which is incorporated in its entirety by reference herein. In the embodiment of FIG. 30, a filler piece 3510 is used to fill the gap between cable retractor modules 1010 and adjacent power cassette 1005, as shown in greater detail in FIG. 35.

Figure 20:
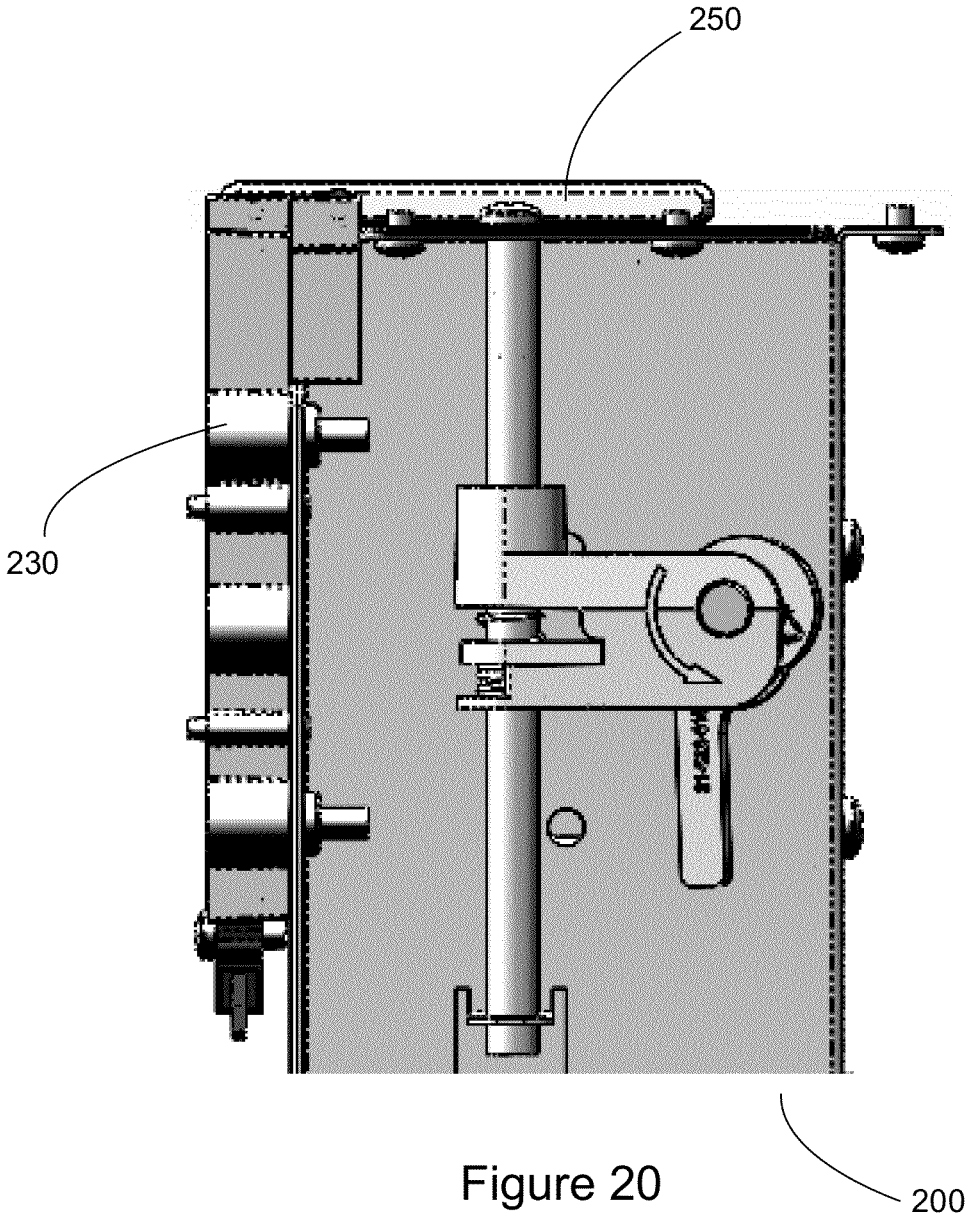
FIG. 20 is a side detail view of an enclosure module of an embodiment of the invention.
Figure 21:
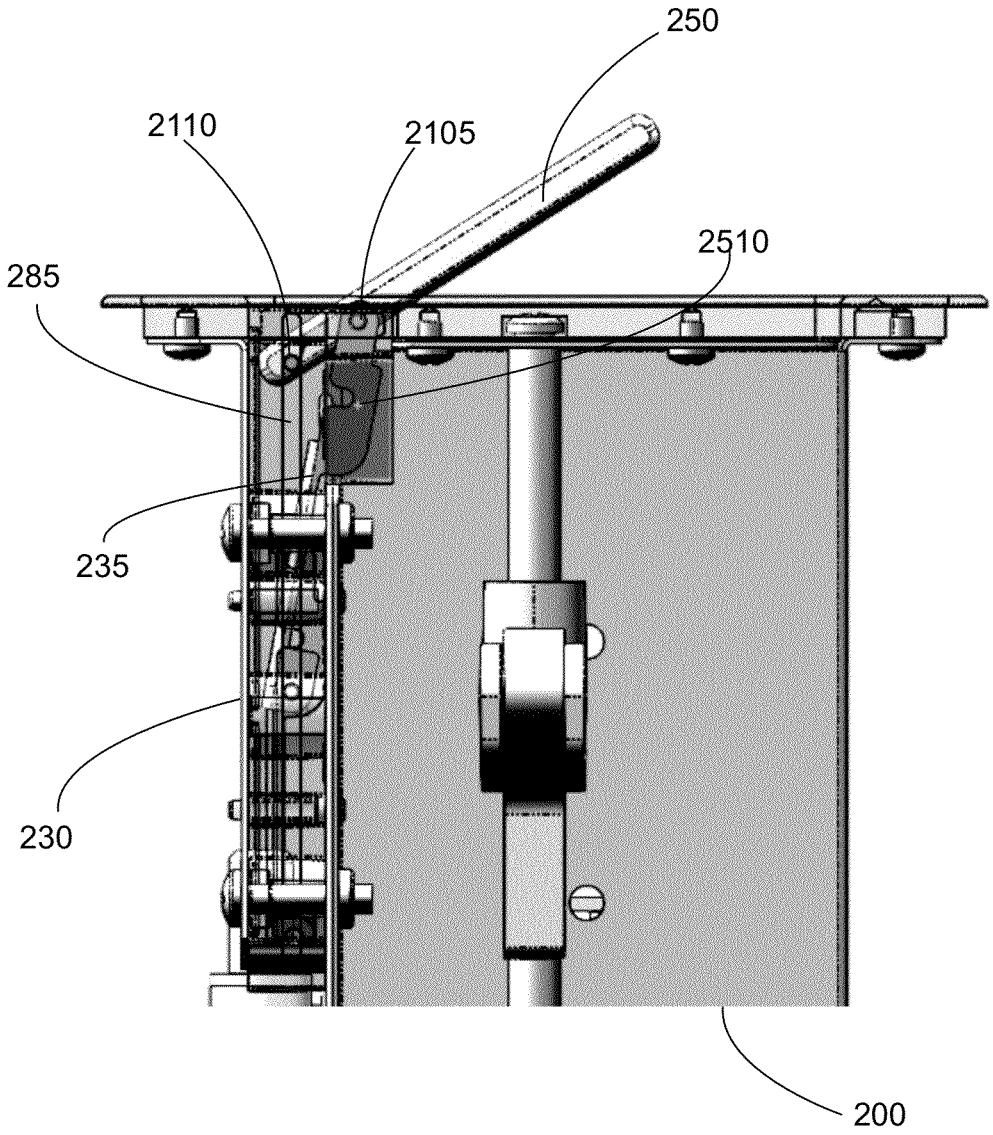
FIG. 21 is a side phantom view of a lid mechanism of an embodiment of the invention.
Figure 35:
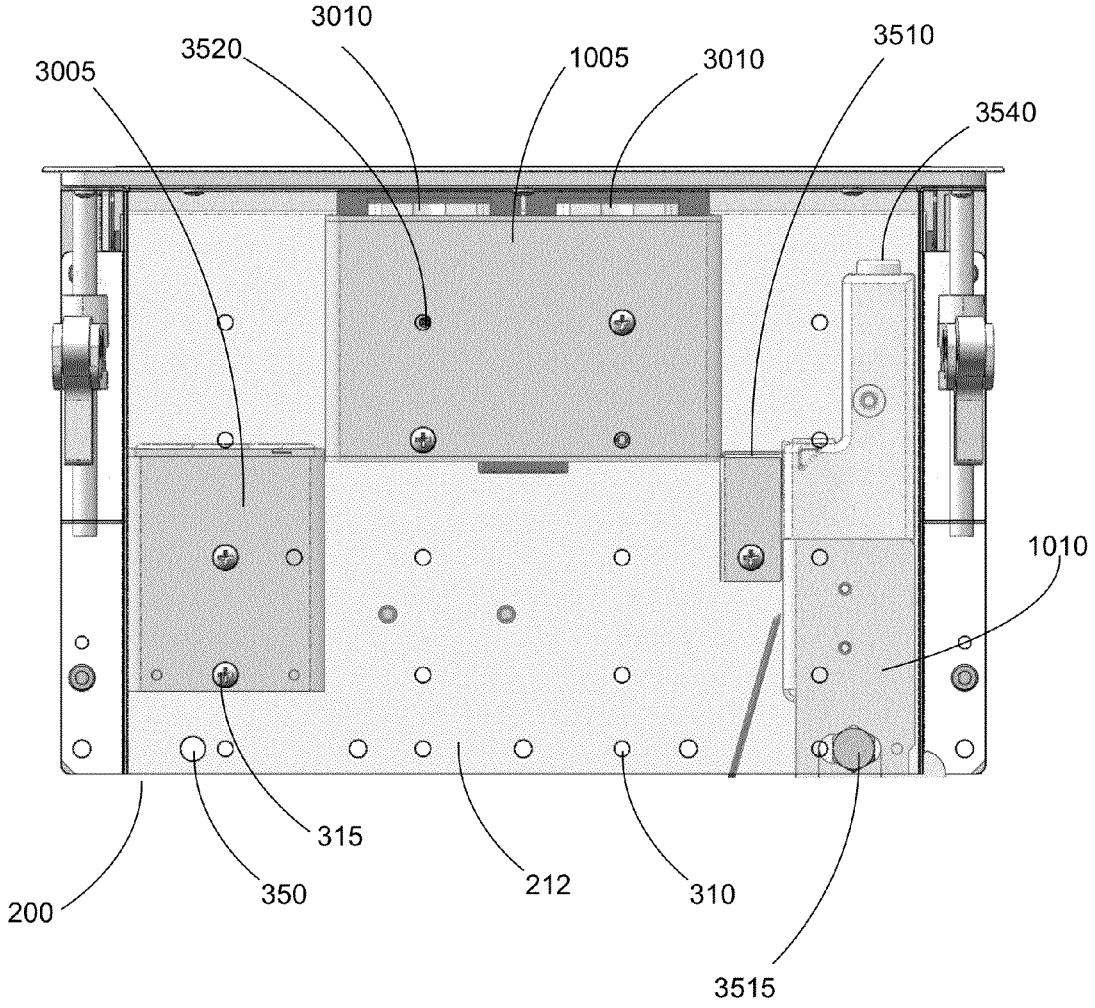
FIG. 35 is a side phantom view of an enclosure of an embodiment of the invention.

FIG. 35 is a front phantom view of module 200 configured as in FIG. 30. In FIG. 35, front side 212 of enclosure module 200 is rendered transparent to show the arrangement of modules and cassettes in the interior of enclosure module 200. In the embodiment of FIG. 20, front side 212 is configured with mounting holes 310 and 350 that are arranged to allow the mounting of modules and cassettes to the interior of enclosure module 200 at various heights or tiers. In the embodiment of FIG. 35, power cassette 1005 is mounted at the top tier position, such that it's top with power outlets 3010 are positioned at a convenient location at the top of enclosure module 200. Cable holder cassette 3005 is mounted at the lower tier location, providing room between the top of cable holder cassette 3005 and the top opening of enclosure module 200 for the ends of cables that may protrude from cable holder cassette 3005 in the manner shown, for example, in FIG. 36 (which shows a double-gang cable holder cassette 3620). In the embodiment of FIG. 35, mounting holes 310 in front side 212 of enclosure module 200 and mounting holes 3520 of cassettes 1005 and 3005 are configured such that there is no visible gap between the top right edge of cable holder cassette 3005 and power cassette 1005 when cassette 3005 is mounted at the lower tier location and cassette 1005 is mounted at the upper tier location, as in FIG. 35.

In the embodiment of FIG. 35, cable retractor 1010 is mounted to enclosure module 200 using a bolt 3515 installed in a hole 350 adjacent to the bottom edge of front side 212 such that its top 3540 is recessed somewhat below the top of enclosure module 200. Filler plate 3510 is mounted in a lower tier location such that there is no visible gap between filler plate 3510 and power cassette 1005.

Figure 31:
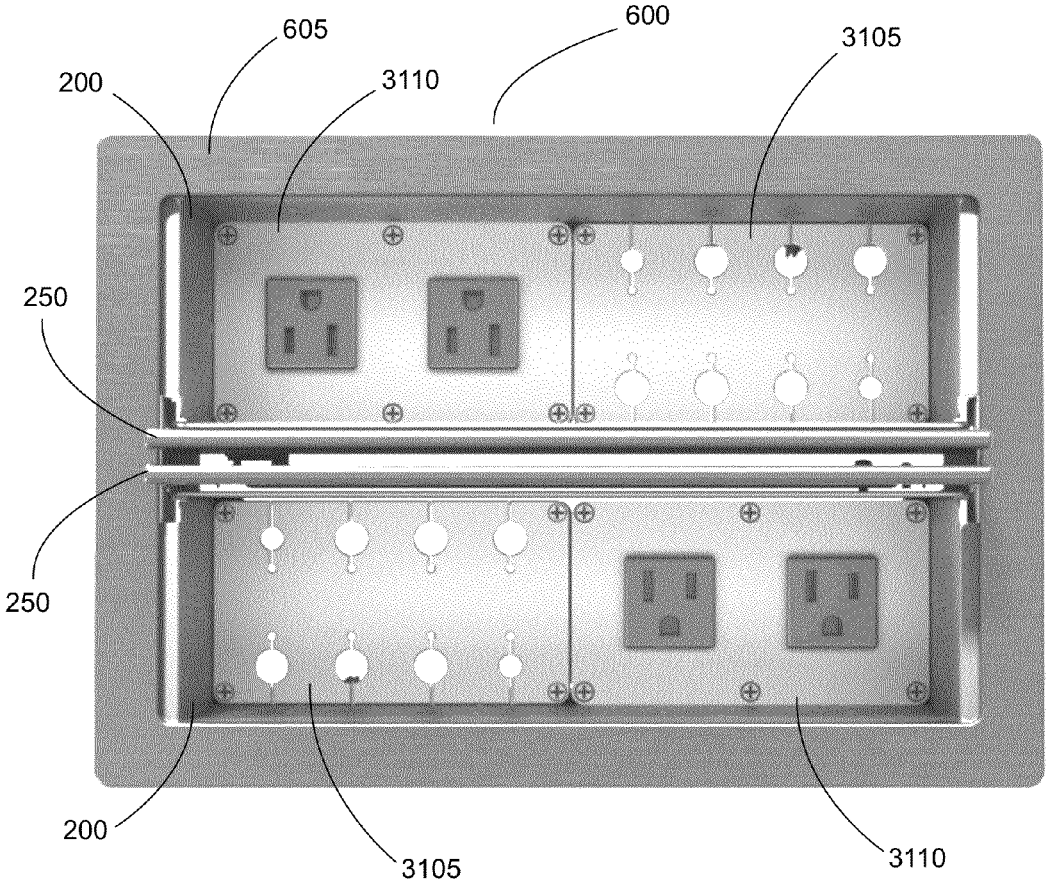
FIG. 31 is a top view of an enclosure of an embodiment of the invention.
Figure 34:
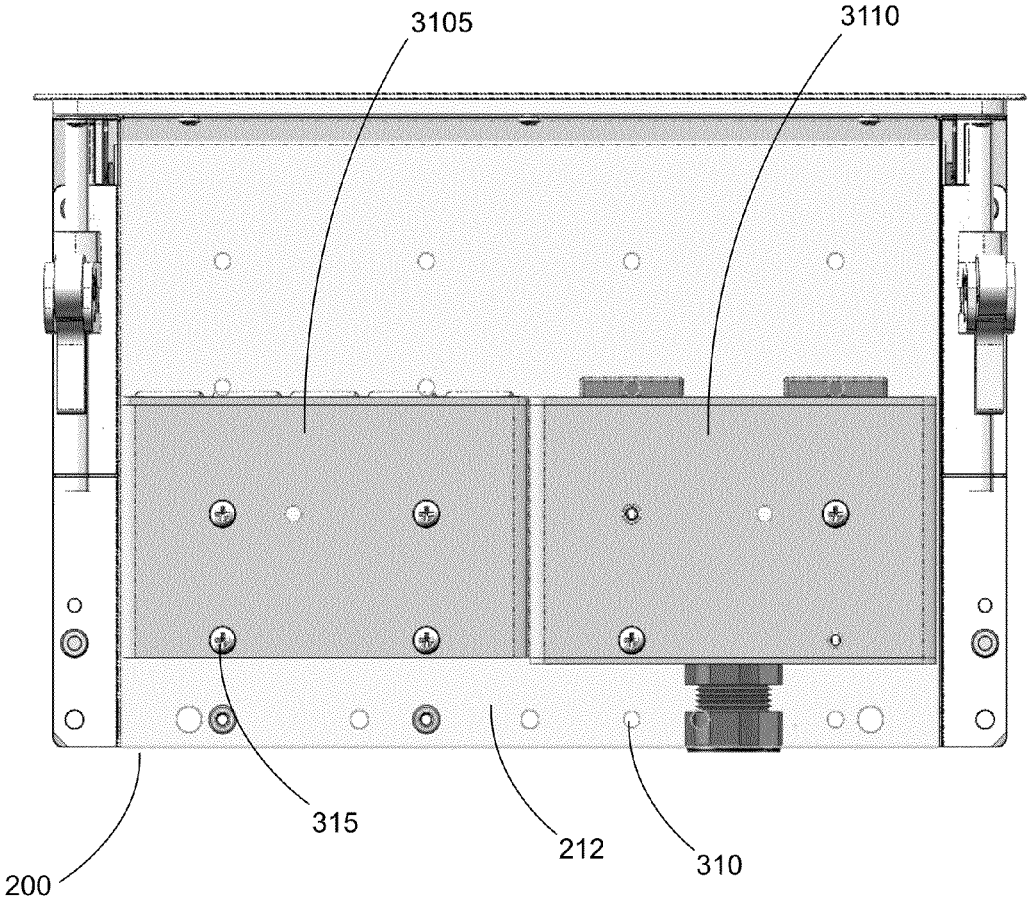
FIG. 34 is a side phantom view of an enclosure of an embodiment of the invention.

FIG. 31 is a top view of an enclosure 600 incorporating two enclosure modules 200 attached back-to-back. Lids 250 are shown in an opened position exposing the interiors of enclosure modules 200. In the embodiment of FIG. 31, each enclosure module 200 has a two-gang cable holder cassette 3105 and a two gang 110 Volt power cassette 3110 mounted within its interior. 7. FIG. 34 is a front phantom view of one of enclosure modules 200 of enclosure 600 of FIG. 31 with front panel 212 rendered transparent to show the configuration of cassettes 3105 and 3110 in the interior of the enclosure module 200. In the embodiment of FIG. 34, cassettes 3105 and 3110 are both mounted at the lower tier position, such that their tops are recessed substantially below the top of enclosure module 200.

Figure 32:
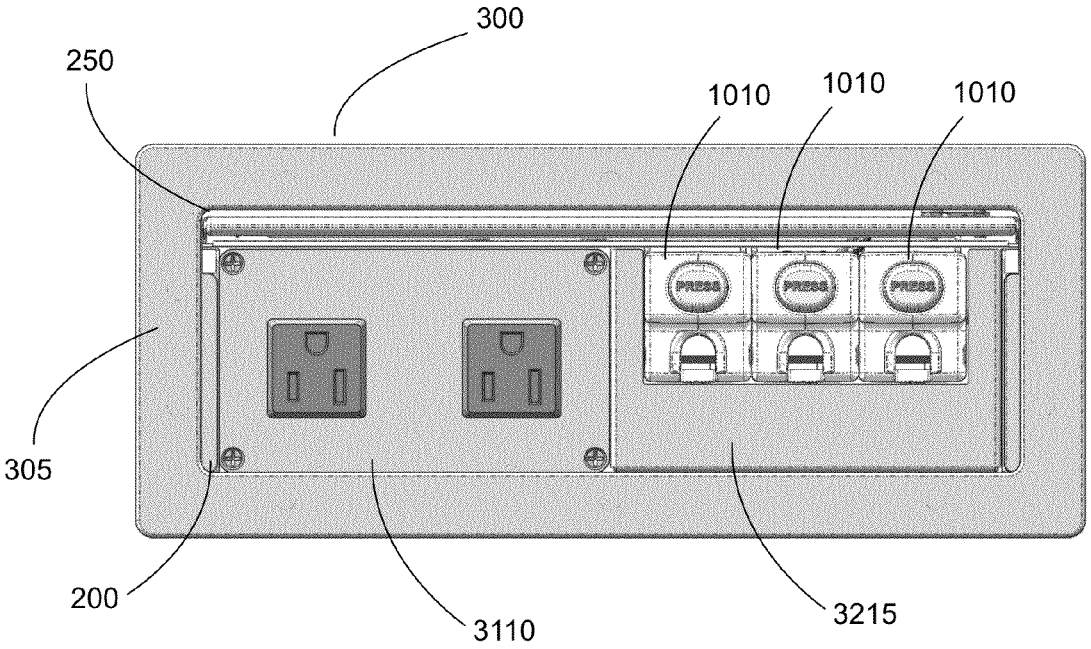
FIG. 32 is a top view of an enclosure of an embodiment of the invention.

FIG. 32 shows a top view of an enclosure 300 incorporating a single enclosure module 200 that contains a two-gang power cassette 3110, three cable retractor modules 1010, and a filler plate 3215.

Figure 33:
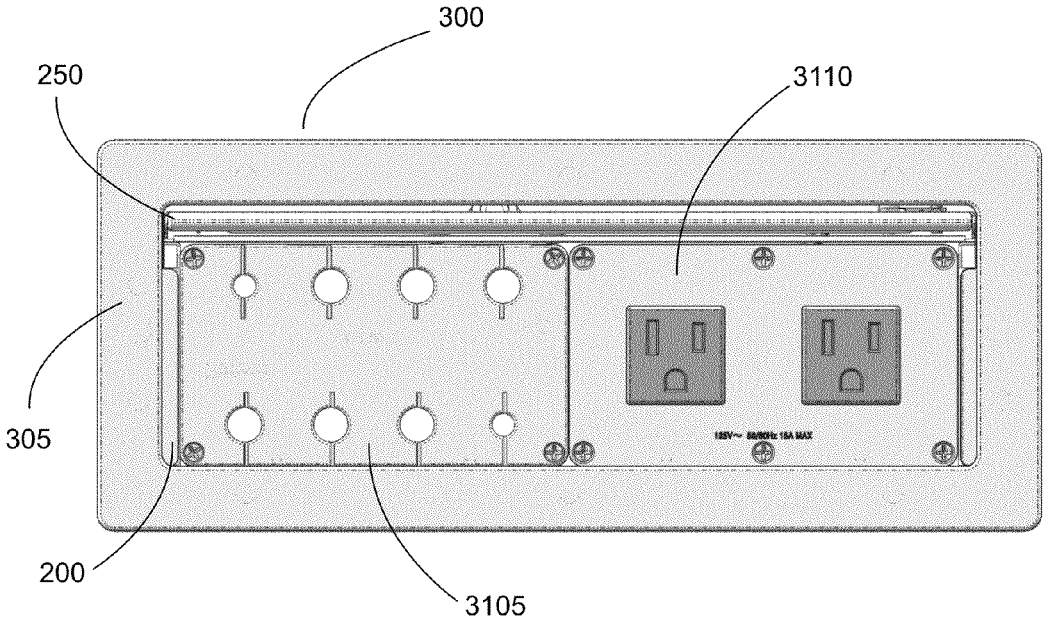
FIG. 33 is a top view of an enclosure of an embodiment of the invention.

FIG. 33 shows a top view of an enclosure 300 incorporating a single enclosure module 200 that contains two-gang cable holder cassette 3105 and a two-gang power cassette 3110 arranged within enclosure module 200 in the same manner cassettes 3105 and 3110 are arranged in enclosure modules 200 of the embodiments of FIGS. 31 and 34.

Figure 36:
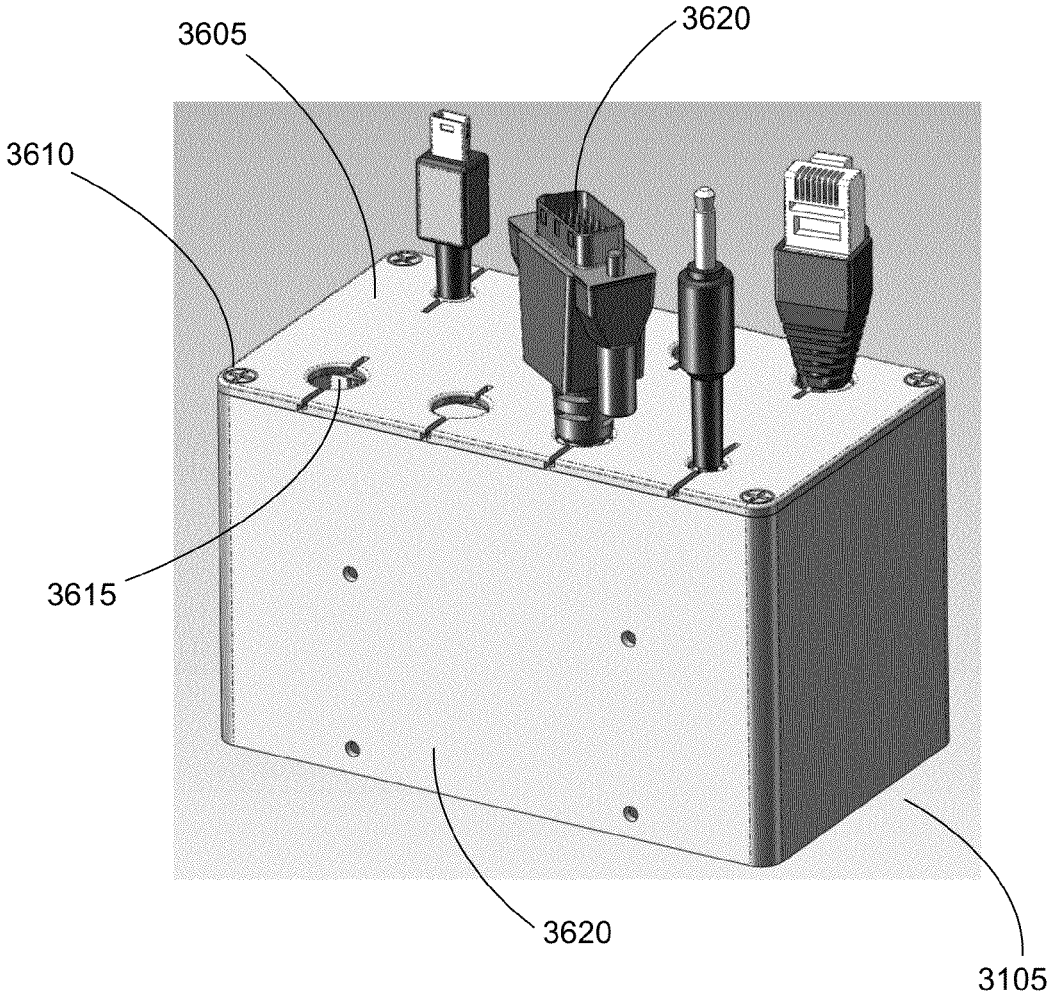
FIG. 36 is a perspective view of a cassette of an embodiment of the invention.
Figure 37:
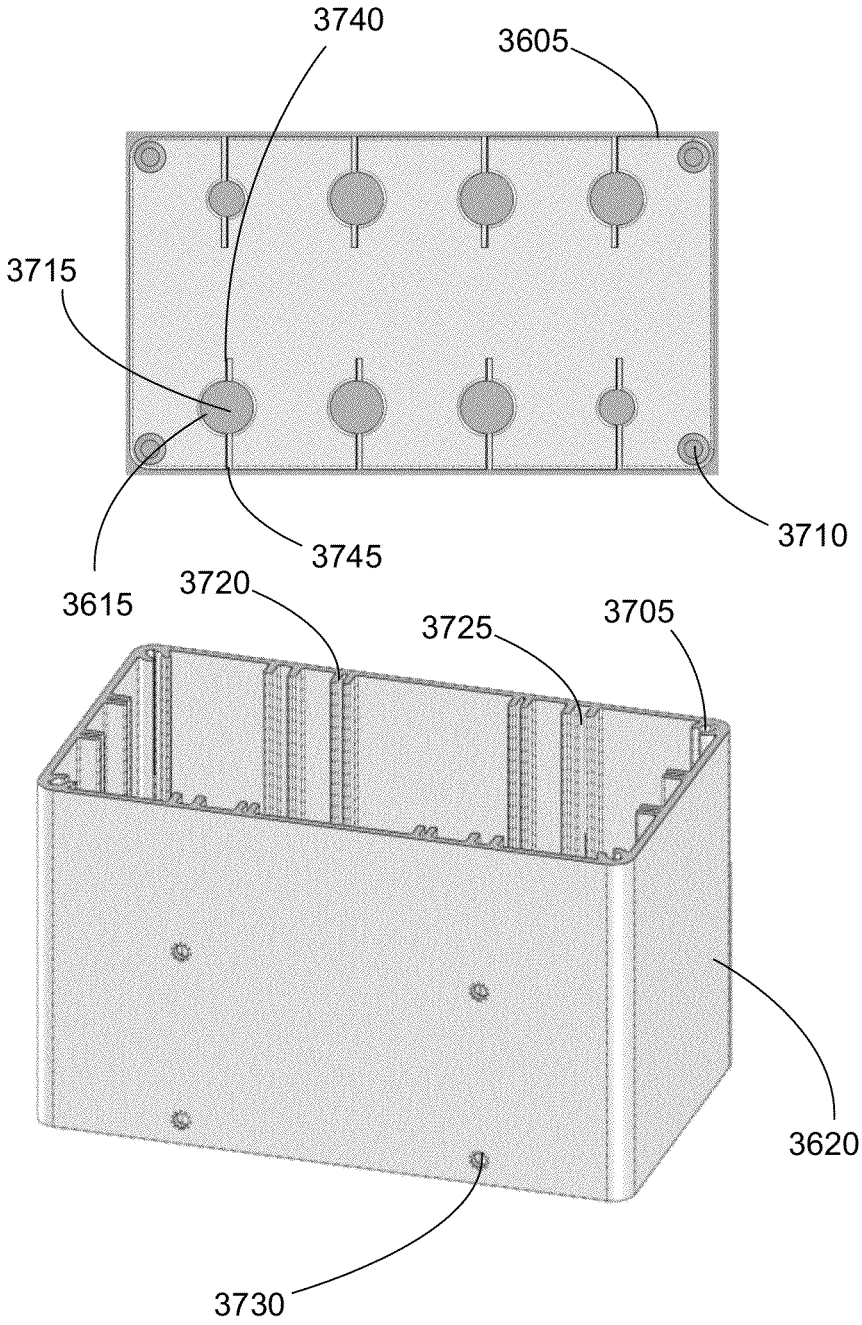
FIG. 37 is a perspective view of a cassette of an embodiment of the invention.
Figure 38:
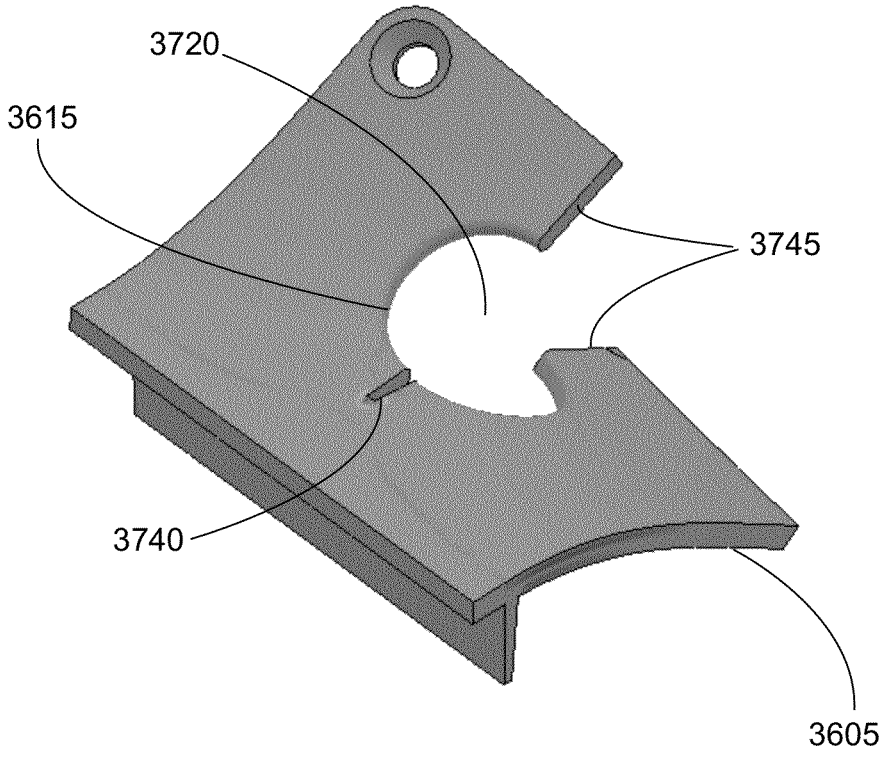
FIG. 38 is a perspective view of a flexible top plate of an embodiment of the invention.

FIGS. 36-38 show details of a two-gang cable holder cassette 3105 of one or more embodiments of the invention. As shown in FIG. 36, cable holder cassette 3105 is assembled by attaching the corners of top plate 3605 to cassette casing 3620 using screws 3610. In the embodiment of FIGS. 36 and 37, top plate 3605 features eight (8) cutouts 3615 into which cables such as cable 3630 (shown in FIG. 36) can be inserted. As shown in FIG. 37, each cutout 3615 includes a round central opening 3715, an inner slot 3740, and an outer slot 3745. Outer slot 3745 extends from central opening 3715 to the perimeter of top plate 3605. Inner slot 3740 extends inwards from central opening 3715 in the opposite direction from outer slot 3745. In one or more embodiments, top plate 3605 is made from a flexibly resilient material such as plastic or rubber that allows top plate 3605 to be flexed about cut-outs 3615, as shown in FIG. 38, to allow the insertion of cables into cut-outs 3615 even after the corners of top plate 3605 have been affixed to casing 3620.

In the embodiment of FIG. 37, cassette casing 3620 is an extruded rectangular casing having an open top and bottom and incorporating a number of integrally formed flanges. Casing 3620 may, for example, constitute a metal (e.g. aluminum) or plastic extrusion. In the embodiment of FIG. 37, the flanges are arranged in pairs and include vertical attachment flange pair 3705, horizontal attachment flange pair 3725, and slot flange pair 3720. Vertical attachment flange pair 3705 is configured to provide a channel into which a threaded fastener, such as for example top plate mounting screw 3610 shown in FIG. 36, may be inserted vertically. Horizontal attachment flange pair 3725 is configured to provide a channel into which fasteners, such as for example cassette mounting screws 315 shown in FIG. 34, may be inserted horizontally through holes such as holes 3730 through the wall of casing 3620 that are aligned with the channel formed by horizontal attachment flange pair 3725. Slot flange pair 3720 is configured to accept a dividing wall, such as dividing wall 4010 shown in FIG. 40.

Figure 39:
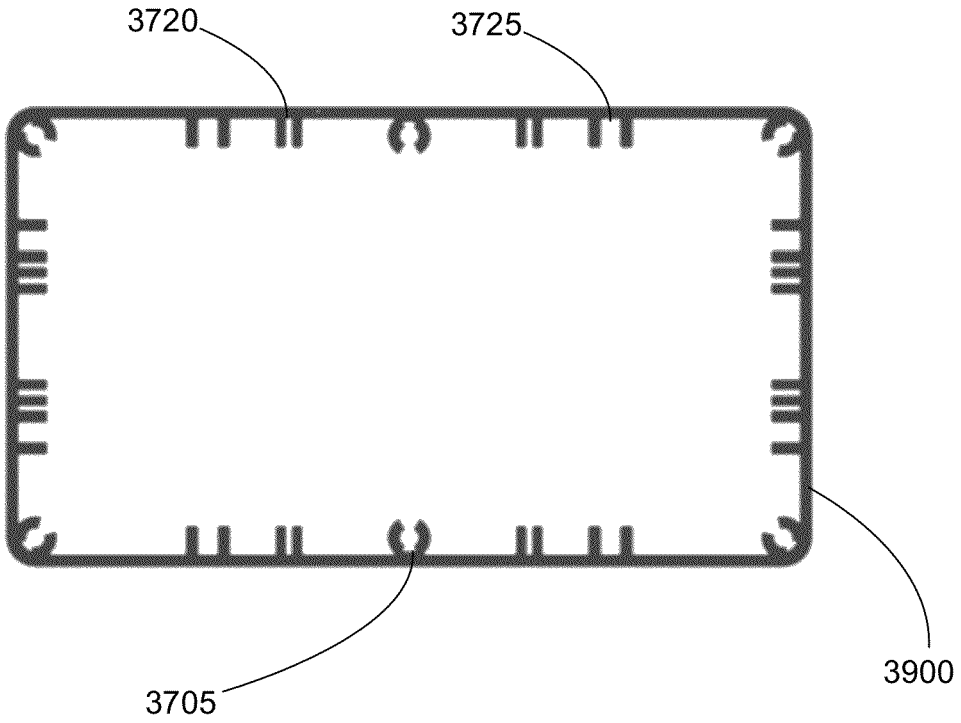
FIG. 39 is a top view of a cassette casing of an embodiment of the invention.

FIG. 39 shows an extrusion profile 3900 for a cassette casing of one or more embodiments of the invention. In the embodiment of FIG. 39, extrusion profile includes six (6) vertical attachment flange pairs 3705, eight (8) horizontal attachment flange pairs 3725, and eight (8) slot flange pairs 3720, arranged as shown in FIG. 39.

Figure 40:
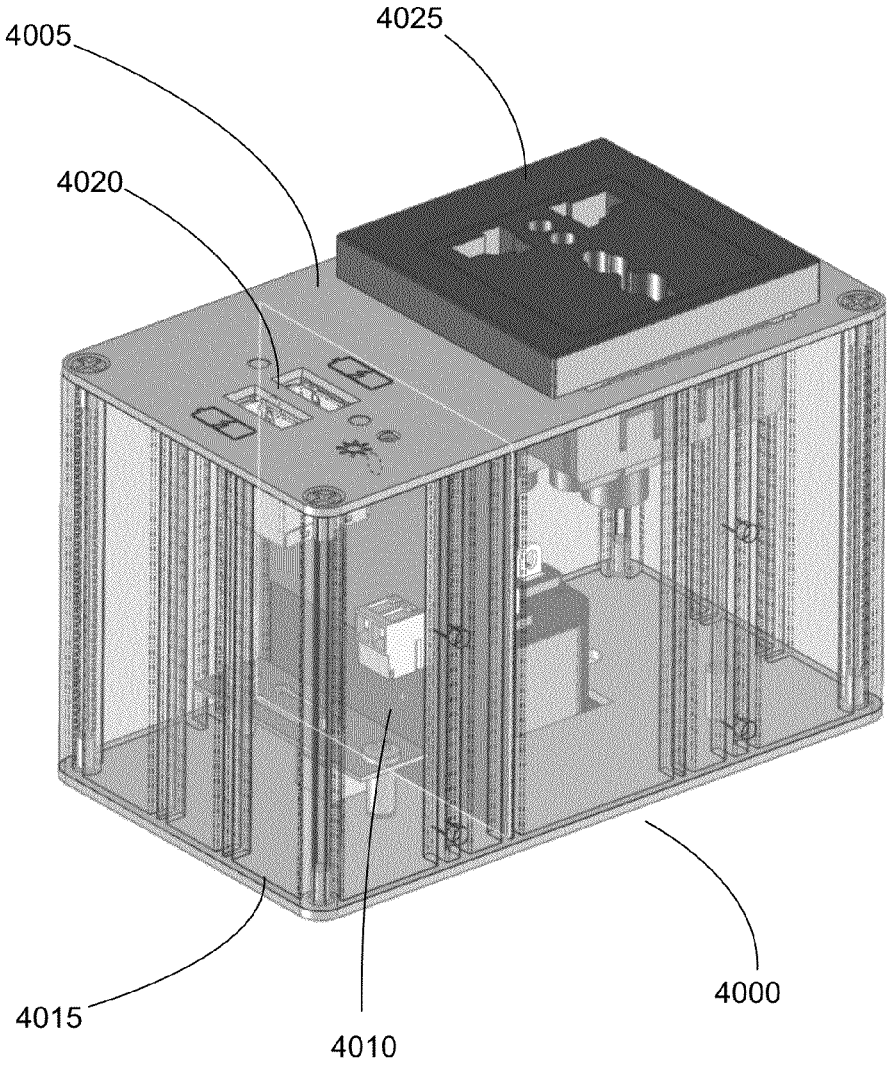
FIG. 40 is a perspective view of a cassette of an embodiment of the invention.

FIG. 40 shows an embodiment of a power cassette 4000 that includes a 220 Volt outlet 4025 and a pair of USB outlets

4020. Cassette 4000 also includes a top plate 4005, a bottom plate 4015, and a dividing wall 4010. In one or more embodiments, dividing wall 4010 is made of sheet metal and is intended to provide shielding and isolation between power outlet 4025 and USB outlets 4020.

Figure 41:
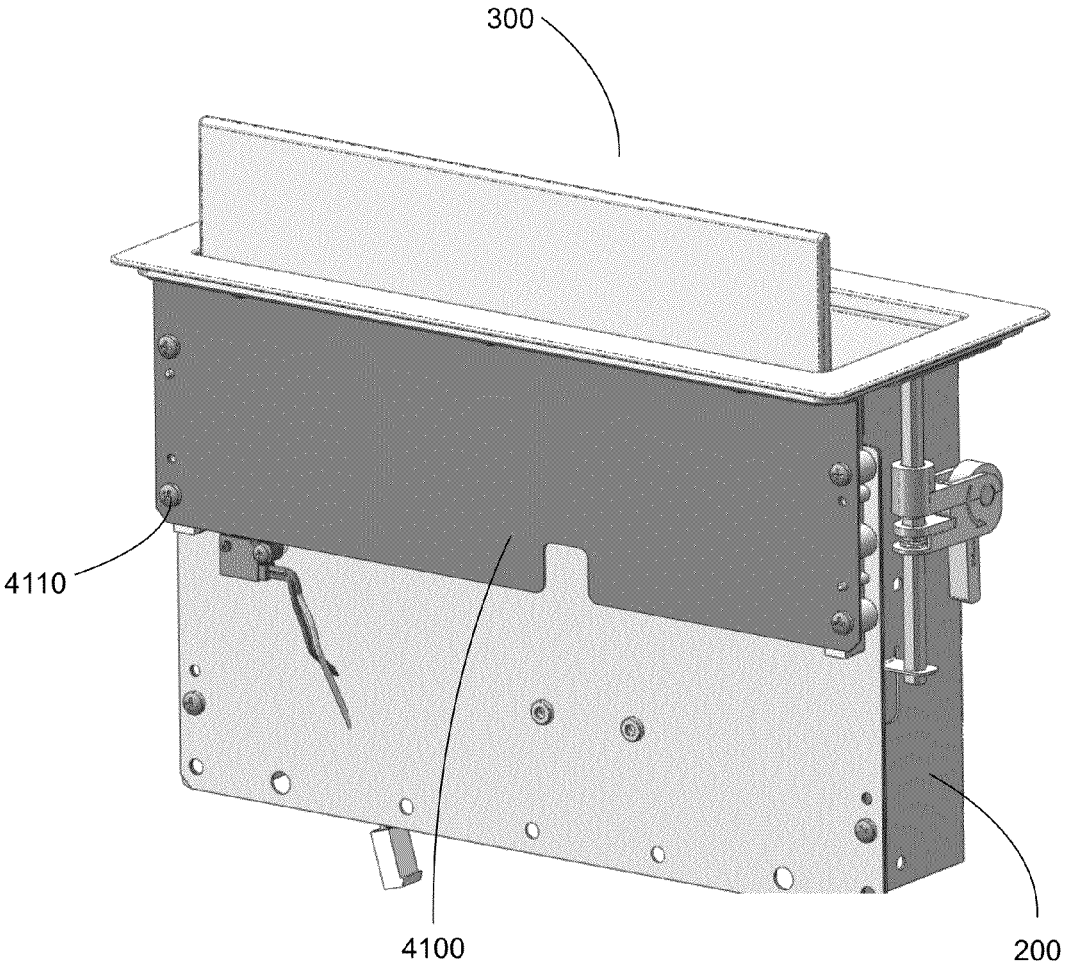
FIG. 41 is a rear perspective view of an enclosure of an embodiment of the invention.
Figure 42:
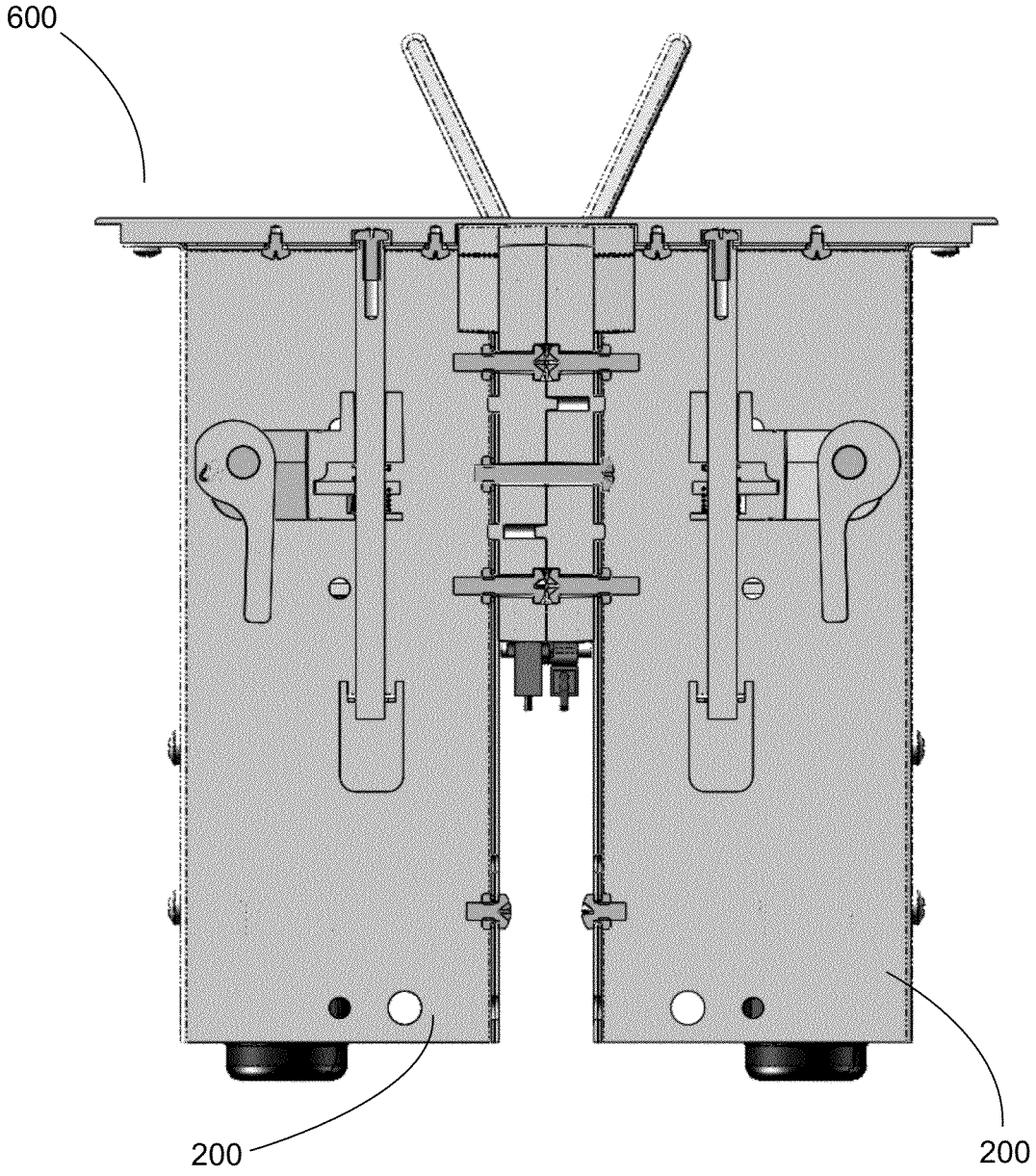
FIG. 42 is a side view of an enclosure of an embodiment of the invention.

FIG. 41 shows an embodiment of an enclosure 300 that includes a single enclosure module 200. In the embodiment of FIG. 41, a protective cover plate 4100 has been attached to enclosure module 200 using threaded fasteners 4110 to cover otherwise exposed components of the lid retraction mechanism of the invention. As shown in FIG. 42, a similar cover plate is not needed in a two-module enclosure such as enclosure 600 in which two enclosure modules are attached back to back such that the lid retraction mechanisms are disposed between the two enclosure modules and therefore not exposed.

Thus a novel surface mountable enclosure has been presented. Although the present invention has been described with respect to certain specific embodiments, it will be clear to those skilled in the art that the inventive features of the present invention are applicable to other embodiments as well, all of which are intended to fall within the scope of the present invention.

What is claimed is:

1. A surface mountable enclosure comprising a bezel and at least one enclosure module, said at least one enclosure module comprising a lid retraction mechanism, said lid retraction mechanism comprising:

a pair of brackets each comprising a channel comprising a first section extending generally in a first direction and a second section extending generally in a second direction, said first section having a length greater than said second section, said first and second sections joining at a first intersection;

a lid comprising first and second sides, each of said first and second sides comprising first and second pins extending from said each first and second sides, said pins configured such that when said lid is in a closed position said first pins engage said second sections of said channels of said pair of brackets and said second pins engage said first intersections of said channels of said pair of brackets and such that when said lid is in an open position said first and second pins engage said first sections of said channels of said pair of brackets.

2. The surface mountable enclosure of claim 1 wherein an angle between said first and second sections of said channel comprises approximately a right angle.

3. The surface mountable enclosure of claim 1 wherein said first direction is generally perpendicular to a plane of said bezel.

4. The surface mountable enclosure of claim 1 wherein said second direction is generally parallel to a plane of said bezel.

5. The surface mountable enclosure of claim 1 further comprising a protective cover adjacent to said pair of brackets.

6. The surface mountable enclosure of claim 1 comprising first and second of said at least one enclosure module.

7. The surface mountable enclosure of claim 1 wherein said pair of said brackets of said first enclosure module are fastened to said pair of brackets of said second enclosure module.

8. A surface mountable enclosure comprising a bezel and at least one enclosure module, said at least one enclosure module comprising at least one clamping mechanism for securing said enclosure to said surface, said clamping mechanism comprising:

a bracket slidably mounted to a shaft attached to said enclosure module, said bracket comprising a locking plate to restrain movement of said bracket along said shaft in a first direction but allowing movement along said shaft a second direction opposite from said first direction;

a cam lever comprising a lever end and a cam lobe pivotally attached to said bracket, said cam lobe having a maximum extent;

wherein said cam lever is configured to contact an underside of said surface at a first location adjacent to said lever end and a second location adjacent to said maximum extent of said cam lobe when said enclosure is mounted to said table.

9. The surface mountable enclosure of claim 8 wherein said at least one clamping mechanism is pivotally mounted to said shaft such that said clamping mechanism is movable from a first position in which said clamping mechanism is disposed entirely beneath said bezel to a second position in which said cam lever end extends beyond said bezel.

10. The surface mountable enclosure of claim 8 comprising a plurality of said at least one clamping mechanism.

11. The surface mountable enclosure of claim 8 wherein said bracket further comprises a spring biasing said locking plate in a first orientation.

12. The surface mountable enclosure of claim 8 comprising first and second of said at least one enclosure module.

13. The surface mountable enclosure of claim 12 comprising a plurality of said at least one clamping mechanism.

14. The surface mountable enclosure of claim 13 wherein each of said first and second of said at least one enclosure modules comprises a plurality of said at least one clamping mechanism.

15. A surface mountable enclosure comprising:

a bezel;

at least one enclosure module, said at least one enclosure module comprising a plurality mount points configured to maintain a plurality of cassettes having standardized sizes at a plurality of mounting positions at first and second tier heights within an interior of said enclosure module, said mount points being configured such that a top of a cassette mounted at a first mounting position at said second tier height is immediately adjacent to a side of a cassette mounted at a second mounting position at said first tier height.

16. The surface mountable enclosure of claim 15 wherein said standardized sizes comprise a single gang size and a double gang size.

17. The surface mountable enclosure of claim 16 further comprising a first single gang cassette mounted at said first tier height and a first double gang cassette mounted at a said second tier height.

18. The surface mountable enclosure of claim 17 wherein said first tier height is closer to said bezel than said second tier height.

19. The surface mountable enclosure of claim 15 further comprising:

a bracket slidably mounted to a shaft attached to said enclosure module, said bracket comprising a locking plate to restrain movement of said bracket along said shaft in a first direction but allowing movement along said shaft a second direction opposite from said first direction;

a cam lever comprising a lever end and a cam lobe pivotally attached to said bracket, said cam lobe having a maximum extent;

wherein said cam lever is configured to contact an underside of said surface at a first location adjacent to said lever end and a second location adjacent to said maximum extent of said cam lobe when said enclosure is mounted to said table.

20. The surface mountable enclosure of claim 15 further comprising:

a pair of brackets each comprising a channel comprising a first section extending generally in a first direction and a second section extending generally in a second direction, said first section having a length greater than said second section, said first and second sections joining at a first intersection;

a lid comprising first and second sides, each of said first and second sides comprising first and second pins extending from said each first and second sides, said pins configured such that when said lid is in a closed position said first pins engage said second sections of said channels of said pair of brackets and said second pins engage said first intersections of said channels of said pair of brackets and such that when said lid is in an open position said first and second pins engage said first sections of said channels of said pair of brackets.

* * * * *